US011369176B2

(12) United States Patent
Bourquin et al.

(10) Patent No.: US 11,369,176 B2
(45) Date of Patent: Jun. 28, 2022

(54) CUSTOMIZABLE BAG WITH RETRACTABLE STRAP

(71) Applicant: Low Ready, Inc., Laguna Niguel, CA (US)

(72) Inventors: Timothy Bourquin, Laguna Niguel, CA (US); Emile Bourquin, Laguna Niguel, CA (US)

( * ) Notice: Subject to any disclaimer, the term of this patent is extended or adjusted under 35 U.S.C. 154(b) by 0 days.

(21) Appl. No.: 17/376,236

(22) Filed: Jul. 15, 2021

(65) Prior Publication Data

US 2022/0031037 A1 Feb. 3, 2022

Related U.S. Application Data

(60) Provisional application No. 63/057,921, filed on Jul. 29, 2020.

(51) Int. Cl.

| | |
|---|---|
| ***A45F 3/02*** | (2006.01) |
| ***A45C 13/30*** | (2006.01) |
| ***A45C 13/26*** | (2006.01) |
| ***A45F 3/14*** | (2006.01) |
| ***A45F 5/00*** | (2006.01) |

(52) U.S. Cl.

CPC ..... *A45C 13/30* (2013.01); *A45C 13/26* (2013.01); *A45F 3/02* (2013.01); *A45F 3/14* (2013.01); *A45F 5/004* (2013.01); *A45F 2003/142* (2013.01)

(58) Field of Classification Search

CPC .... A45F 2003/142; A45F 3/047; A45F 5/004; A45F 3/02; A45F 3/14; A45C 13/30; A45C 13/26

See application file for complete search history.

(56) References Cited

U.S. PATENT DOCUMENTS

| | | | | | |
|---|---|---|---|---|---|
| 2,662,619 | A * | 12/1953 | Zweigbaum | A45C 3/02 | 190/115 |
| 3,198,300 | A * | 8/1965 | Tuttle | A45F 3/02 | 16/405 |
| 5,005,868 | A * | 4/1991 | Stern | A63C 17/0006 | 224/162 |
| 5,027,874 | A * | 7/1991 | Gazzola | A45C 13/26 | 150/108 |

(Continued)

*Primary Examiner* — Adam J Waggenspack

(74) *Attorney, Agent, or Firm* — Camille A. Wilson; Wilson Dutra, PLLC

(57) ABSTRACT

The present disclosure provides for a bag with a retractable strap and different variations of accessory panels located throughout the bag. In some aspects, the retractable strap may be moved into different orientations on the bag rather than a stagnant placement throughout the use of the bag. In some embodiments, the bag may have several interior and exterior accessory panels that allow for limitless combinations of accessories to be added for maximum customization from bag to bag. In some implementations, the bag and frame may be made up of different materials depending on the intended use of the bag. In some embodiments, the retractable strap may have different length control mechanisms, allowing the strap to be retractable no matter the orientation. In some implementations, the retractable strap may extend via a constant force spring. In some aspects, the rotational force of the extension of the constant force spring may provide a constant force.

11 Claims, 24 Drawing Sheets

(56) References Cited

U.S. PATENT DOCUMENTS

| | | | | | |
|---|---|---|---|---|---|
| 5,240,156 | A * | 8/1993 | Sicotte | A41F 9/002 | 224/148.5 |
| 5,960,952 | A * | 10/1999 | Chen | A45C 13/36 | 190/125 |
| 6,053,381 | A | 4/2000 | Fahl et al. | | |
| 6,109,404 | A * | 8/2000 | Bishop | A45C 5/14 | 190/115 |
| 8,123,092 | B2 * | 2/2012 | Krulik | A45C 13/30 | 224/578 |
| 8,919,628 | B2 * | 12/2014 | Jamlang | A45F 3/14 | 224/583 |
| 9,104,377 | B2 * | 8/2015 | Rekuc | A45C 13/26 | |
| 9,730,507 | B2 | 8/2017 | Wendler | | |
| 10,264,874 | B2 * | 4/2019 | Becker | A45F 5/02 | |
| 10,618,771 | B2 | 4/2020 | Joyner | | |
| 10,863,817 | B2 * | 12/2020 | Yeates | A45F 5/00 | |
| 2008/0302623 | A1 * | 12/2008 | Gupton, Jr. | A45C 13/02 | 190/110 |
| 2021/0376658 | A1 * | 12/2021 | Marino | A41D 27/208 | |

* cited by examiner

FIG. 4A
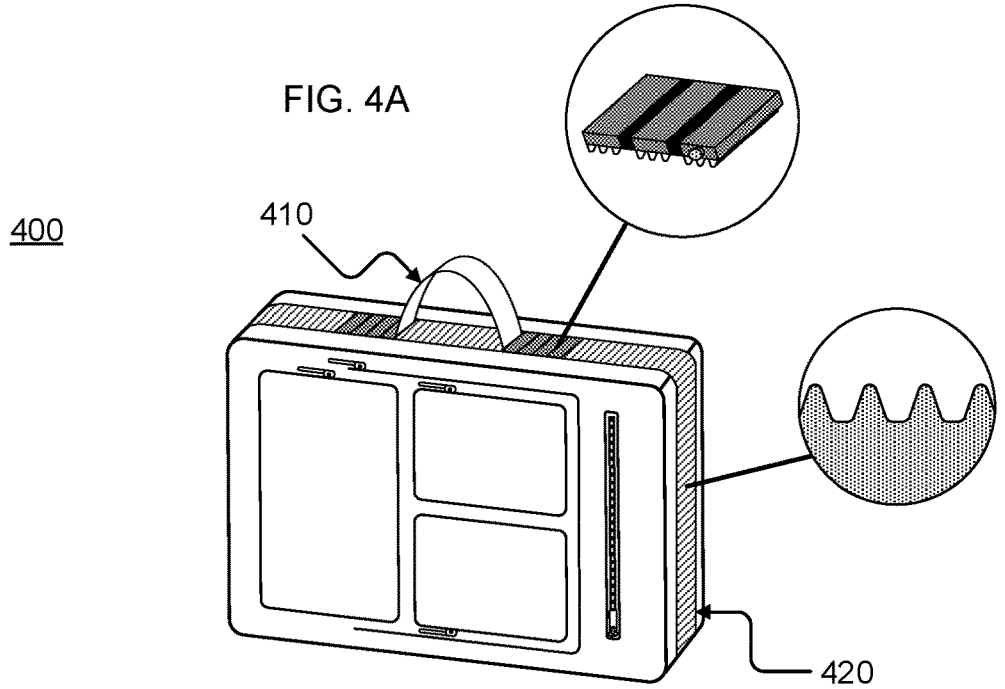
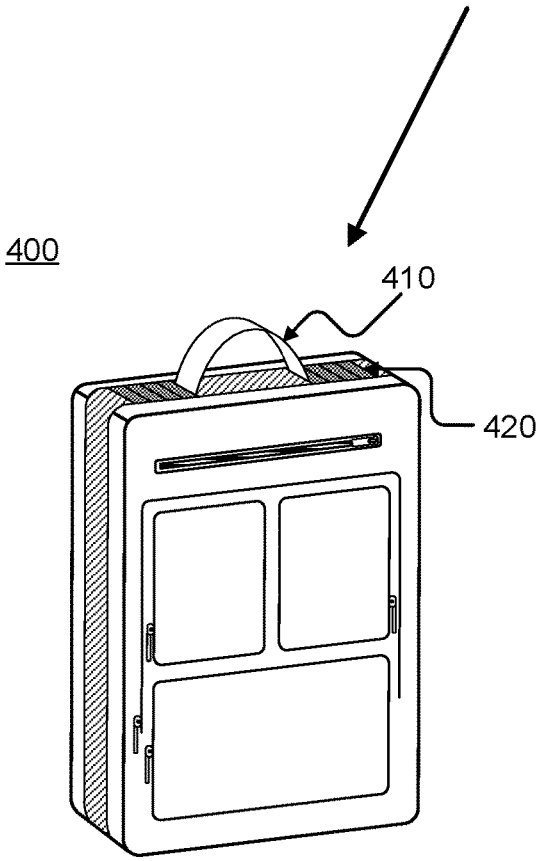
FIG. 4B
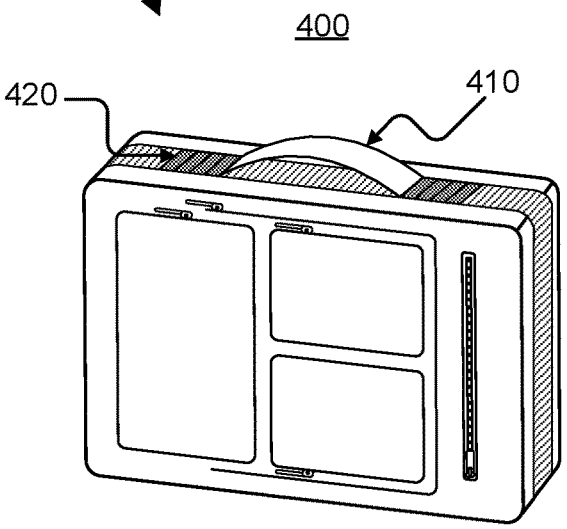
FIG. 4C

700

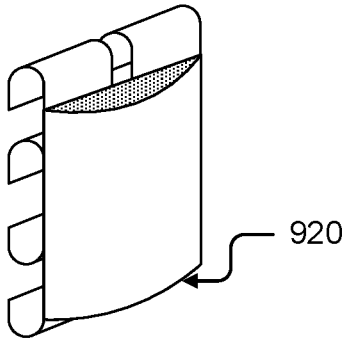
FIG. 9B
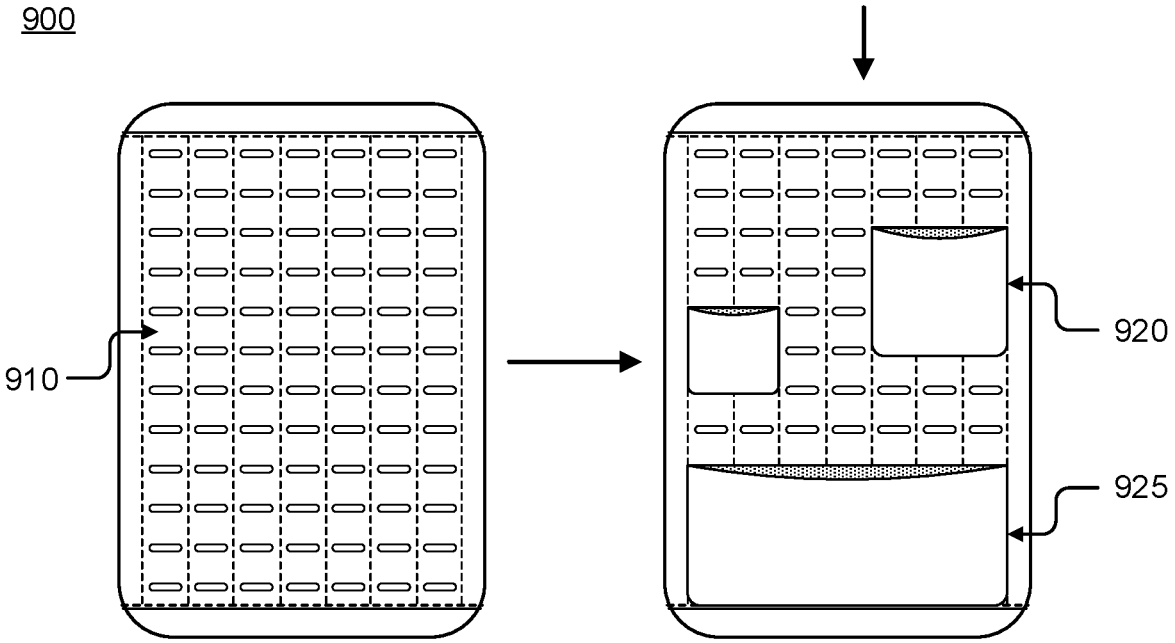
FIG. 9A
FIG. 9C

CUSTOMIZABLE BAG WITH RETRACTABLE STRAP

CROSS-REFERENCE TO RELATED APPLICATION

This application claims priority to and the full benefit of U.S. Provisional Patent Application Ser. No. 63/057,921, filed Jul. 29, 2020, and titled "CUSTOMIZABLE BAG WITH RETRACTABLE STRAP", the entire contents of which are incorporated in this application by reference.

BACKGROUND

Though originally developed as a tool for more easily carrying several objects at a time, society's use of bags has evolved over time. Zippers, clasps, magnets, and other features were added to help secure items inside a bag and ensure that a bag stayed closed despite its contents. Pockets and other smaller compartments were introduced to streamline organization of items within a bag. Some bags include external compartments that may hold different items, or items that can be accessed quickly, such as pens, bottles, or external batteries for charging devices.

In addition to the many features that bags have integrated over the decades, specialized bags have been created for specific purposes. Purses and backpacks are among the most common and used most generally, or, in the case of purses, for special occasions. Purses and backpacks are among the most common and can be used generally or for special occasions. Large and rigid luggage were created to provide a safe way to transport items long distances. Plastic bags are often used to store liquids, foods, and to transport groceries and other store-bought items. Some bags were created with the dimensions and for the safety of transporting fragile or sensitive materials, such as laptops.

As their uses have transformed over time, many bags have been rather impractical and uncomfortable no matter the adjustment or orientation. Bags are generally limited to what they can carry and what material they are made of. While it is possible to use additional, smaller bags or containers to create a similar effect in some instances, it is difficult or impossible to remove compartments within a bag for those that desire additional storage space or would never use such features. In some instances, bags are easy to carry around as a personal item but are unable to carry more than the travel essentials. Often, bags have one orientation of a carrying strap, which cannot be changed for comfort or ease of travel. Although bags have adapted over the years allowing cables to pass through using cord holes, most are still very impractical.

While straps may be adjustable on some bags, straps normally still hang from the bag at all times. When not in use, straps go from a necessity of the bag to a cumbersome, and potentially dangerous, feature. If placed on the floor, bag straps may act as tripping hazards. Bags with dangling straps may also make theft easier. Loose bag straps may become dirtier than the rest of the bag.

Some bag straps lack length and orientation customization, which in turn decreases comfort customization options. Often, most bags lack durability both in their outer material and in their framing because they are made with cheaper materials. Additionally, bags are limited to what they can carry without straining the neck and shoulder of the user.

SUMMARY OF THE DISCLOSURE

What is needed is a customizable bag with a retractable strap and easy to access accessory panels. In some aspects, the bag may have a strap that expands and retracts into the bag itself when not in use. In some embodiments, the tension for the retractable strap may keep tension regardless of how far the retractable strap is pulled or extended. In some implementations, the bag may have a strap that stays extended if a user needs the strap. For example, the user may pull on the strap to lock it into place while they are actively using the strap and then enable an unlocking mechanism to store the strap when no longer in use. In some embodiments, accessory panels may be located throughout the bag and come in different shapes, sizes, and materials based on user customization.

In some implementations, a bag may have different variations of the retractable strap from bag to bag depending on the user request. In some aspects, the orientation may be adjustable from vertical to horizontal orientations. In some implementations, the types of retraction mechanisms may vary from spring-loaded, to buckle, to positioning track, and other non-limiting examples.

In some embodiments, the bag may have different accessory panels on the interior. In some implementations, the interior panel may not be limited to a side on the interior of the bag. In some aspects, more than one interior panel may exist on one bag. For example, an interior accessory panel may be located on one or both the front and back of the bag on the interior.

In some implementations, the exterior accessory panels may follow the same orientation as that of the interior panels. In some aspects, as long as the exterior panels do not interfere with the retractable strap or other basic flow of the bag, they may exist anywhere on the exterior of the bag. In some embodiments, the exterior panels may comprise a durable material than the interior panels because they are being exposed to more wear on the outside of the bag.

In some implementations, the frame of the bag may be made up of different materials depending on the desired use of the bag. For example, a more frequent traveler may want the frame of their bag to be a stronger material than someone who travels less frequently. As another example, material and structure for a bag for professional use may differ than that for a bag for more rugged uses. In some aspects, the frame may be coated or padded to protect both the frame and the contents of the bag from fall damage. In some embodiments, the frame may be sealed to make the interior waterproof, protecting the interior contents from water damage.

In some implementations, accessory panels may use different attachments and methods to keep accessories secured to each panel. For example, a hook and loop mechanism may be used on either side of the attachment to keep it in place on the panel after the object has been snapped into the attachment. In some aspects, the bag may come with permanent attachments, such as a modular battery that charges mobile devices on the go.

The present disclosure relates to a bag with retractable strap. In some embodiments, the bag and retractable strap may comprise a frame that may comprise a center frame that may comprise four connected rigid walls, and an outer frame that may comprise at least two rigid walls configured to attach to at least a portion of the center frame. In some implementations, the bag may include a retractable strap that may comprise a first end and a second end; an outer material configured to cover a portion of the retractable strap and a portion of the outer frame, where the outer material may comprise a first strap opening and a second strap opening; an inner material covering the center frame, where the inner lining may be configured to form an interior containing recess of the bag; an outer panel configured to be partially detachable to allow access to the interior containing recess; a set of constant force springs configured to control a set of positions of the retractable strap, where a first constant force spring may be connected to the first end and a second constant force spring may be connected to the second end; and a set of frame mounts configured to mount the set of constant force springs to the center frame, where a first frame mount mounts the first constant force spring to the center frame and a second frame mount mounts the second constant force spring to the center frame, and where, when mounted, the retractable strap extends through the first strap opening and the second strap opening allowing for access to the retractable strap.

In some aspects, the bag may comprise a backpack. In some embodiments, the bag may comprise a laptop bag. In some implementations, one or both the outer panel and the inner material may comprise a modular pocket system. In some aspects, one or both the first frame mount and the second frame mount may be configured to shift to a plurality of positions, where shifting changes an orientation of the bag when held by the retractable strap. In some embodiments, the retractable strap may comprise a flexible material. In some implementations, a length of the retractable strap may be adjustable. In some aspects, the handle may be parallel to the retractable strap. In some embodiments, the retractable strap further may comprise a handle opening configured to fit around the handle when the retractable strap may be in a retracted state.

The present disclosure relates to a retractable strap mechanism for a bag with a frame that may comprise a center frame may comprise four connected rigid walls, and an outer frame may comprise at least two rigid walls configured to attach to at least a portion of the center frame. In some implementations, the retractable strap mechanism may include a retractable strap that may comprise a first end and a second end; a set of constant force springs configured to control a set of positions of the retractable strap, where a first constant force spring may be connected to the first end and a second constant force spring may be connected to the second end; and a set of frame mounts configured to mount the set of constant force springs to the center frame, where a first frame mount mounts the first constant force spring to the center frame and a second frame mount mounts the second constant force spring to the center frame, and where, when mounted, the retractable strap extends through the first strap opening and the second strap opening allowing for access to the retractable strap.

In some embodiments, the retractable strap mechanism where the retractable strap may comprise a flexible material. In some implementations, the bag may comprise a backpack. In some aspects, a length of the retractable strap may be adjustable. In some embodiments, one or both the first frame mount and the second frame mount are configured to shift to a plurality of positions, where shifting adjusts the length of the retractable strap. In some implementations, the handle may be parallel to the retractable strap. In some aspects, the retractable strap further may comprise a handle opening configured to fit around the handle when the retractable strap may be in a retracted state.

In some embodiments, the set of constant force springs may extend via rotational extension. In some implementations, the set of constant force springs may transfer rotational retention force to a linear force exerted on the retractable strap mechanism. In some aspects, the force exerted by the set of constant force springs on the retractable strap mechanism may be configured to be variably adjusted. In some embodiments, the force exerted by the set of constant force springs on the retractable strap mechanism may be maintainable in a modified level of constant force by an external force exerted on the set of constant force springs.

BRIEF DESCRIPTION OF THE DRAWINGS

The accompanying drawings that are incorporated in and constitute a part of this specification illustrate several embodiments of the disclosure and, together with the description, serve to explain the principles of the disclosure:

FIG. 4A illustrates an exemplary bag with a retractable strap, wherein the bag comprises a positioning track.

FIG. 4B illustrates an exemplary bag with a retractable strap, wherein the retractable strap is vertically oriented.

FIG. 4C illustrates a front view of an exemplary bag with a retractable strap, wherein the retractable strap is horizontally oriented.

FIG. 9A illustrates an exemplary accessory panel for a bag with a retractable strap, according to some embodiments of the present disclosure.

FIG. 9B illustrates an exemplary accessory for a bag with a retractable strap, according to some embodiments of the present disclosure.

FIG. 9C illustrates an exemplary accessory panel with accessory for a bag with a retractable strap, according to some embodiments of the present disclosure.

DETAILED DESCRIPTION

The present disclosure provides generally for a customizable bag with a retractable strap. According to the present disclosure, a bag may comprise a retractable strap that may retract when the bag is not carried, which may limit damage and soiling of a loose strap. The present disclosure provides for means of controlling tension for the retractable strap so that the tension is evenly distributed regardless of how far the retractable strap is extended.

In the following sections, detailed descriptions of examples and methods of the disclosure will be given. The description of both preferred and alternative examples, though thorough, are exemplary only, and it is understood to those skilled in the art that variations, modifications, and alterations may be apparent. It is therefore to be understood that the examples do not limit the broadness of the aspects of the underlying disclosure as defined by the claims.

Glossary

Bag: as used herein refers to any portable vessel that may hold objects. In some aspects, a bag may comprise a purse, computer bag, or briefcase. In some implementations, a bag may comprise luggage. In some embodiments, a bag may be customized internally, such as internal compartments or storage components, or externally, such as for location of certain features.

Retractable Strap: as used herein refers to a bag strap that retracts when the strap is not in use or when a user decides to retract the strap.

Accessory Panel: as used herein refers to a portion of the bag that allows for modular attachment of accessories, such as pockets, holders, charging units, and organizers, as non-limiting examples. In some aspects, an accessory panel may comprise a material that may allow for easy and secure attachment. The material may comprise hook and loop or magnet. In some embodiments, an accessory panel may comprise a series of attachment mechanisms, such as "MOLLE" (Modular Lightweight Load-carrying Equipment), snaps, sleeves, or buttons, as non-limiting examples.

Figure 1A:
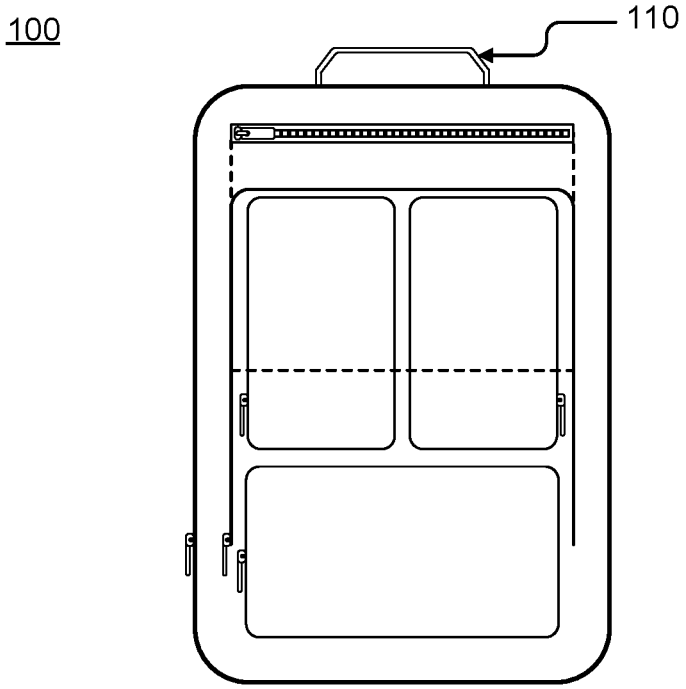
FIG. 1A illustrates a front view of an exemplary bag with a retractable strap.
Figure 1B:
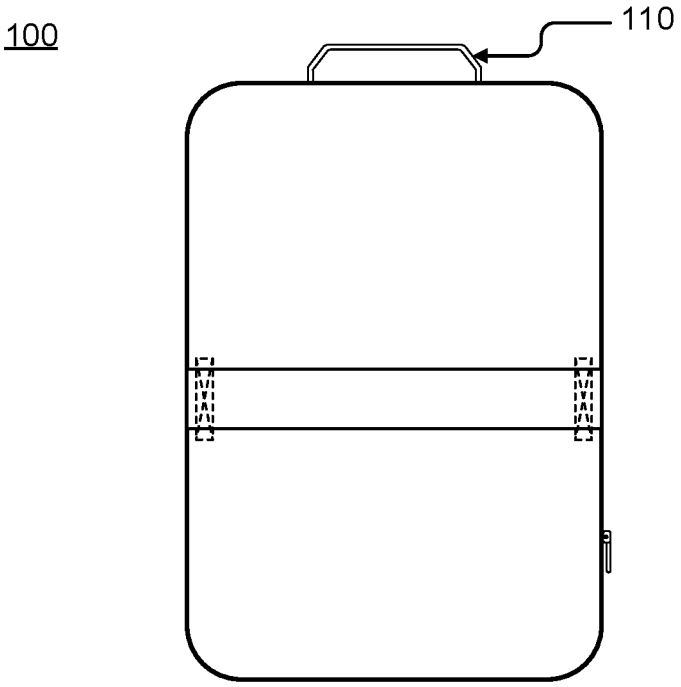
FIG. 1B illustrates a back view of an exemplary bag with a retractable strap.

Referring now to FIG. 1A-B, a front view of an exemplary bag 100 with a fixed strap 110 is illustrated. In some embodiments, a retractable strap may fold into different areas of the bag 100. In some implementations, the retractable strap may retract and extract from the top of the bag 100 as shown. In some aspects, the fixed strap 110 may be moved or manufactured on a different spot of the bag 100.

For example, the fixed strap 110 may allow for horizontal orientation of the bag or vertical orientation of the bag 100, depending on user preference, bag configuration, or effective use. The retractable strap 110 may comprise a fixed position, wherein the bag 100 may be held in a traditional matter.

In some aspects, the fixed strap 110 may fit over the retractable strap on the exemplary bag 100. In some embodiments, when the retractable strap is retracted into the exemplary bag 100 the fixed strap 110 may then be placed over the top. In some implementations, the fixed strap 110 may be attached to the exemplary bag 100 using a snap-in system or other non-limiting examples that secure the fixed strap 110 onto the exemplary bag 100.

For example, the top of the exemplary bag 100 may have snaps and the bottom of the fixed strap 110 may have snaps as well that fit into the snaps on the top of the exemplary bag 100. In some implementations, the fixed strap 110 may be screwed into the top of the exemplary bag 100. For example, a screw or bolt system may come with the fixed strap 110 and help fasten it to the top of the exemplary bag 100 where the retractable strap is retracted. In some embodiments, the fixed strap 110 may be removed at any time by the user to use the retractable strap 110 once the fixed strap 110 has been removed.

In some embodiments, one or more compartments may be located on the front or back of the bag 100. In some implementations, a shallow front pocket may allow for small travel items that are easily accessible from the pocket. In some aspects, shallow pocket may be open and closed using a zipping system. In some embodiments, the pocket may be open and closed using snaps, magnets, hook and loop, or any other non-limiting examples that allow the pocket to be opened and closed securely.

In some embodiments, the bag 100 may comprise other pockets on the front that may comprise a plurality of sizes and shapes from the original variation of the pocket. In some aspects, these pockets may be locked and secured to ensure contents inside are not misplaced. In some implementations, a locking system may be built into the pockets, wherein a lock may be used to secure the pockets. In some aspects, each pocket may have its own locking system. In some embodiments, the back of the bag 100 may comprise a retractable strap on the back used to attach to a suitcase or another bag 100 for travel.

For example, the back strap may be used to slide the bag 100 over the handle of a suitcase for easy travel. In some aspects, the back strap may be used to strap larger objects to the back of the bag 100. In some embodiments, a larger tablet may be secured in the back of the bag 100 for travel. In some implementations, the rear strap may be adjustable to secure different sized things. For example, for a smaller object the rear strap may be tightened and for a larger object the back strap may be loosened for a secure fit.

Figures 2A, 2B:
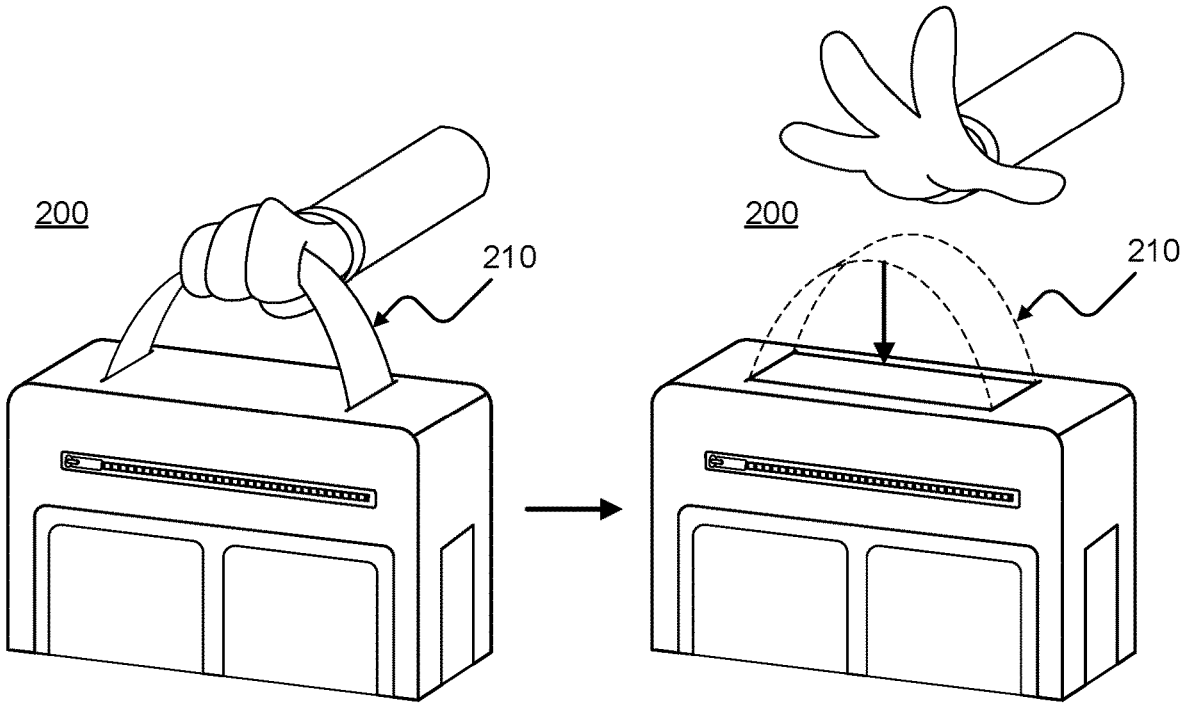
FIG. 2A illustrates an exemplary bag with a retractable strap, wherein the retractable strap is extended.
FIG. 2B illustrates an exemplary bag with a retractable strap, wherein the retractable strap is retracted.

Referring now to FIG. 2A-B, an exemplary bag 200 with a retractable strap 210 is illustrated, wherein the retractable strap 210 is extended and retracted. In some embodiments, the retractable strap 210 may retract into the top of the bag 200 and can have slits on either side so that the strap 210 sits on the top of the bag 200.

For example, there may be slits on either side of the top portion of the bag 200 and either side of the retractable strap 210 may retract into either side. In some implementations, the retractable strap 210 may be pulled to full extension to retract back into the bag 200. For example, similar to a seatbelt the retractable strap 210 may be pulled to its full expansion length and then once let go the strap may then retract back into the slits.

In some embodiments, the retractable strap 210 may be locked into any desired length at any time. In some implementations, a locking system may be placed inside the slits of the retractable strap 210 to allow for the strap 210 to be locked in any desired length while being expanded. In some aspects, the locking system may be some sort of teething mechanism that locks around the material of the strap 210. In other embodiments, the locking system may be a two-sided press the squeezes the strap 210 into place from either side. In some implementations, these may not be the only non-limiting examples to the locking system within the bag 200. In some embodiments, the retractable strap 210 may comprise any lightweight non-frictional material that allows for maximum comfort and durability.

For example, the retractable strap 210 could be made of a polyester webbing that helps keep the durability of the figure while making it easy to extract and retract for daily use. In some implementations, the retractable strap 210 may be changed out if it becomes damaged or broken. In some aspects, the retractable strap 210 may come in different colors from the bag 200 or it may be the same color as the bag 200. In some implementations, the retractable strap 210 may be a different material from the bag 200.

Figure 3A:
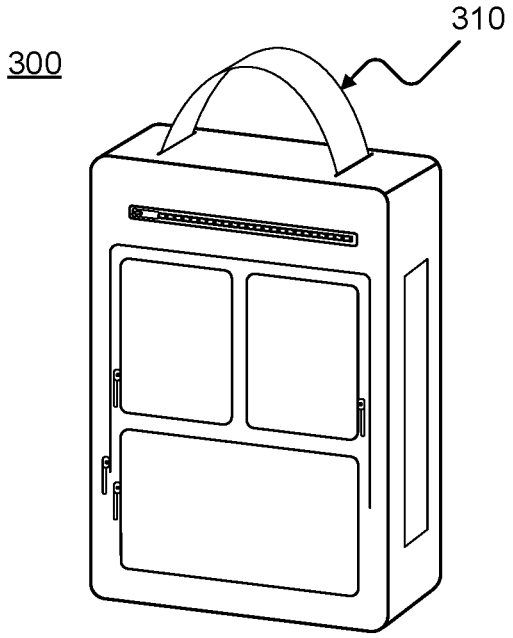
FIG. 3A illustrates an exemplary bag with a retractable strap, wherein the bag is vertically oriented.
Figure 3B:
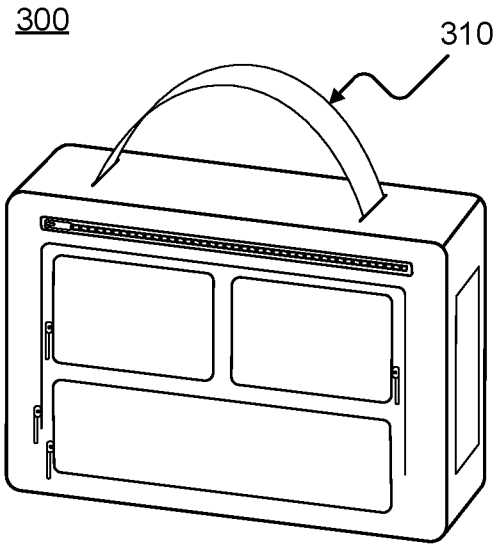
FIG. 3B illustrates an exemplary bag with a retractable strap, wherein the bag is horizontally oriented.

Referring now to FIG. 3A, an exemplary bag 300 with a retractable strap 310 is illustrated, wherein the bag 300 is vertically oriented. Referring now to FIG. 3B, an exemplary bag 300 with a retractable strap 310 is illustrated, wherein the bag 300 is horizontally oriented. In some embodiments, the retractable strap 310 could come in pairs in some forms of the bag 300. For example, one retractable strap 310 may be at the top of the bag 300 while another may be located at one side of the bag 300. In some implementations, this may allow for the bag 300 to be carried at different orientations based on preference or comfortability. In some aspects, the retractable strap 310 may be moved to either orientation at any moment in time. For example, there may be incisions on one side of the bag 300 and at the top, allowing the singular retractable strap 310 to be moved from either the top or the side of the bag 300.

In some embodiments, the orientation of the bag 300 may not affect the pockets or other straps 310 on the bag 300 once changed. For example, if the orientation of bag 300 is switched from vertical to horizontal the pockets and compartments may not be affected by the switch. In some implementations, the bag 300 may only have one orientation rather than the option for two or more orientations. For example, rather than the option to change from a top strap 310 to a side strap 310 the retractable strap 310 may only comprise one orientation.

Referring now to FIG. 4A, an exemplary bag 400 with a retractable strap 410 is illustrated, wherein the bag 400 comprises a positioning track 420. Referring now to FIG. 4B, an exemplary bag 400 with a retractable strap 410 is illustrated, wherein the retractable strap 410 is vertically oriented. Referring now to FIG. 4C, a front view of an exemplary bag 400 with a retractable strap 410 is illustrated, wherein the retractable strap 410 is horizontally oriented.

In some embodiments, a positioning track 420 may exist on the outer workings of the bag 400. In some aspects, the positioning track 420 may be used to adjust the length and positioning of the retractable strap 410. In some embodiments, sliding pieces may be inserted throughout the positioning track 420 to help slide the retractable strap 410 back and forth to adjust the length. In some implementations, the sliding pieces may be clicked or placed into the groves of the positioning track 420.

In some aspects, a button may be used to slide each end of the strap 410 along the positioning track 420 to aid in changing the length and orientation of the retractable strap 410. In some embodiments, the positioning track 420 may be removed at any time or rearranged in a different orientation to accustom the person using the bag 400. For example, positioning tracks 420 may be located on both the top and sides of the bag 400 so that the retractable strap 410 may be placed on different sides of the bag 400. In some implementations, the retractable strap 410 length and tightness may be affected by the position of each end on the positioning track 420.

Figure 5A:
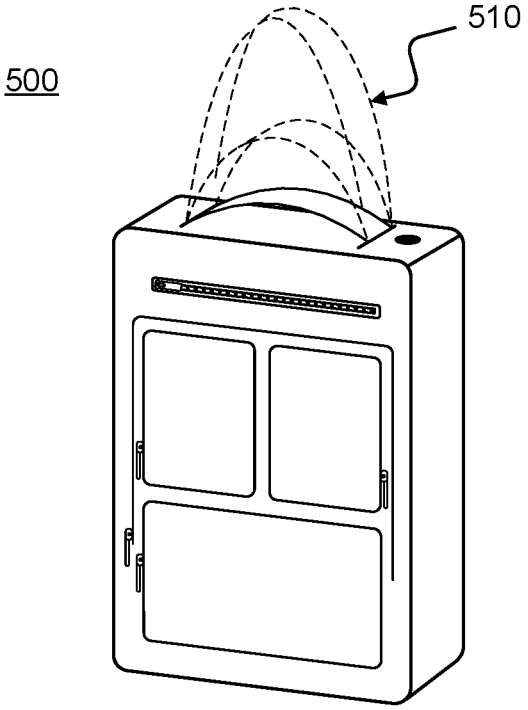
FIG. 5A illustrates an exemplary bag with a retractable strap, wherein position of the retractable strap is adjustable.
Figure 5B:
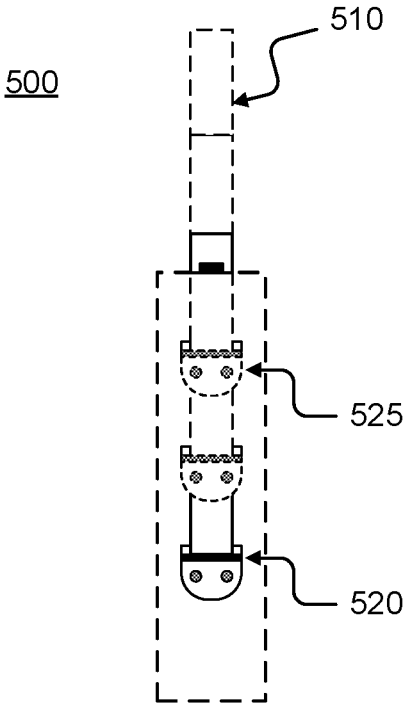
FIG. 5B illustrates an exemplary bag with a retractable strap, wherein position of the retractable strap is adjustable.

Referring now to FIG. 5A-B, an exemplary bag 500 with a retractable strap 510 is illustrated, wherein position of the retractable strap 510 is adjustable is illustrated. In some aspects, a retractable strap 510 may attach to the bag 500 through a constant force spring 520. In some embodiments, a position of the constant force spring 520 may be adjusted at preset locations, such as through a plurality of notches. In some implementations, a bag 500 may comprise a positioning mechanism 525 that may allow for easy adjustment of the length of extension for the retractable strap 510. In some aspects, the bag 500 may have a positioning mechanism 525 that can be used to lock and release the retractable strap 510. For example, when a button is being pressed then the retractable strap 510 can be adjusted freely. In some embodiments, the bag 500 may have different types of positioning mechanisms 525 that are not limited to a button, but may include a notch or knob, as non-limiting examples.

In some implementations, the positioning mechanism 525 may be used to activate a constant force spring 520 that allows the retractable strap 510 to adjust. In some aspects, the constant force spring 520 may be used to adjust the sides of the retractable strap 510. In some embodiments, the bag 500 may have notches on the side to catch the spring at different lengths and hold the retractable strap 510 at those respective lengths. In some implementations, the notches may be separated by similar distances, incremental distances, or they may be adjusted (freely?) alongside the exterior of the bag 500.

In some embodiments, these notches may be placed at the top of the bag 500 to help adjust the vertical length of the retractable strap 510. In some implementations, the notches may compress and expand the constant force spring 520 helping with the extension and retraction of the retractable strap 510. For example, if the constant force spring 520 is compressed then the strap 510 may be fully extended and if the constant force spring 520 is fully expanded then the strap 510 may be fully retracted.

Figure 6A:
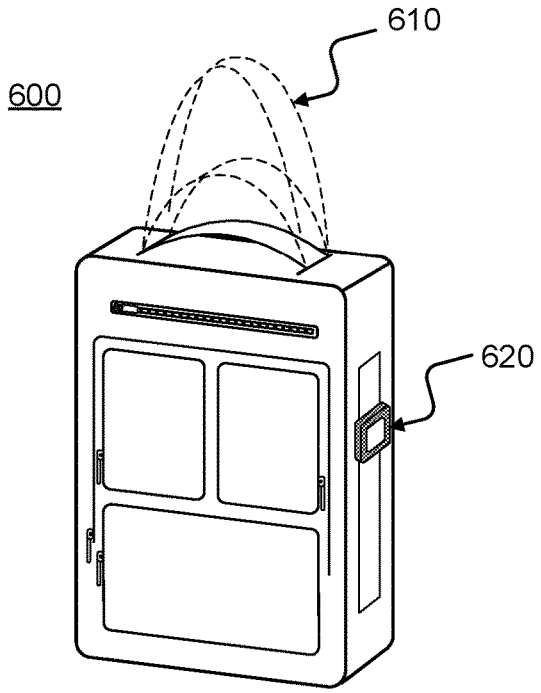
FIG. 6A illustrates an exemplary bag with a retractable strap, wherein position of the retractable strap is adjustable.
Figure 6B:
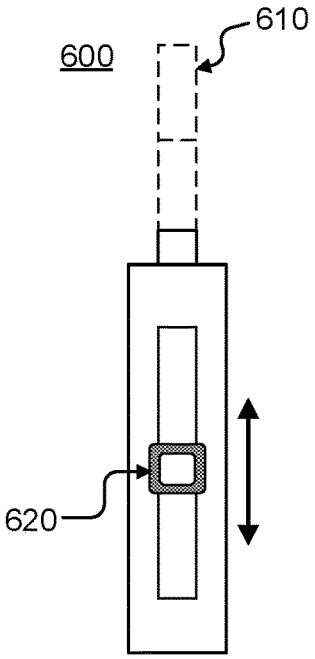
FIG. 6B illustrates an exemplary bag with a retractable strap, wherein position of the retractable strap is adjustable.
Figure 6C:
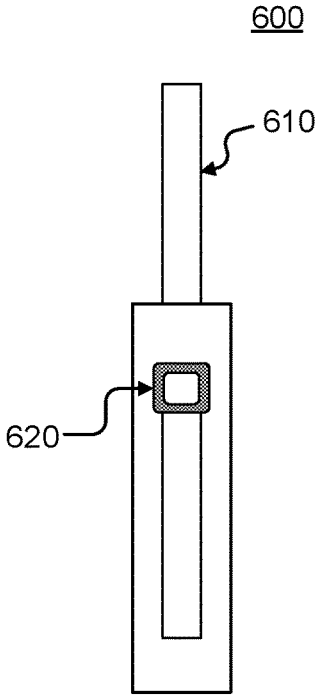
FIG. 6C illustrates an exemplary bag with a retractable strap, wherein position of the retractable strap is adjustable.

Referring now to FIG. 6A, an exemplary bag 600 with a retractable strap 610 is illustrated, wherein position of the retractable strap 610 is adjustable through a length-control mechanism 620. Referring now to FIG. 6B, an exemplary bag 600 with a retractable strap 610 is illustrated, wherein position of the retractable strap 610 is adjustable. Referring now to FIG. 6C, an exemplary bag 600 with a retractable strap 610 is illustrated, wherein position of the retractable strap 610 is adjustable. In some aspects, a length-control mechanism 620 may comprise a buckle that may allow for adjustment of the length of the retractable strap 610 when extended.

In some implementations, the length-control mechanism 620 may be located on the side exterior of the bag 600. In some embodiments, the length-control mechanism 620 may have a buckle that helps with the adjustment of the retractable strap 610. In some implementations, the buckle may have a teeth like system that helps it stay secure on the length-control mechanism 620 to ensure that the buckle stays in place and the length is not compromised during use. In some aspects, the length-control mechanism and buckle may be relocated to a different part of the exterior of the bag 600.

In some implementations, the buckle may be freely adjusted, or it may automatically catch on the length-control mechanism 620 once the user begins to use the bag 600. For example, the retractable strap 610 may be placed onto the shoulder of a person and adapt to the proper length that the bag 600 needs to sit at for optimal use. In some embodiments, the buckle on the length-control mechanism 620 may be locked into place and the retractable strap 610 may be fully retracted onto the outer surface of the bag 600. In some aspects, this mechanism may be used for travel purposes when the bag 600 is being stored and the retractable strap 610 needs to be secured.

Figure 7A:
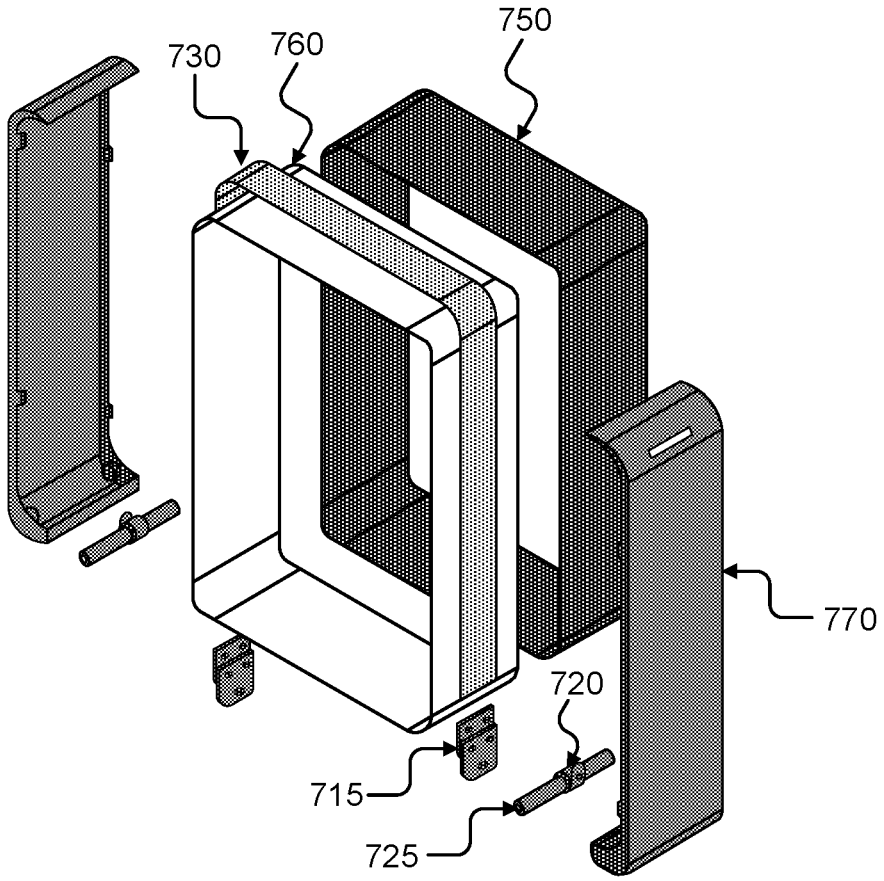
FIG. 7A illustrates an exploded view of a frame of an exemplary bag with a retractable strap.

Referring now to FIG. 7A, an exploded view of a frame 700 of an exemplary bag with a retractable strap 730 is illustrated, wherein a retractable strap may be extended and retracted through a constant force spring 720. In some embodiments, the frame 700 of a bag may be comprised of different materials that allow for reinforcement when dropped to allow for maximum protection of the objects inside.

For example, the frame 700 material may be a hard plastic coated by a polyester material to give the bag a sleeker look. In some embodiments, the frame 700 and the material may be separated by a layer of foam that adds even more protection to the objects inside. In some aspects, the frame 700 may comprise interior grooves that may accommodate a plurality of objects inside, such as a laptop or other technological devices, as non-limiting examples.

In some embodiments, the frame 700 may comprise one or more frame components. In some implementations, the frame 700 may comprise an inner frame 750, center frame 760, and outer frame 770, as non-limiting examples. In some aspects, the inner frame 750 may retain the shape and alignment, as non-limiting attributes, of the retractable strap.

In some embodiments, the frame 700 may comprise a center frame 760. In some implementations, the center frame 760 may interface with the inner frame 750 to one or more channels for the retractable strap to move within. In some aspects, the center frame may provide form and protection, as non-limiting attributes, to the frame 700.

In some embodiments, the frame 700 may comprise an outer frame 770. In some implementations, the outer frame 770 may provide an interface between the retractable strap and the external environment. As an example, the outer frame 770 may comprise a slot that allows a portion of the retractable strap to extend beyond the bag for external use. As another example, the outer frame 770 may be removeable to allow for replacement of parts of the bag including, but not limited to, the constant force spring 720, the frame mount 725, or an attachment mechanism 715.

In some implementations, the constant force spring 720 may be located on either side of the outer frame 770 to connect the retractable strap across the bag and ensure that the strap operates properly. In some implementations, the constant force spring 720 may be attached to either end of the retractable strap for maximum length control and use. In some aspects, the frame 700 may not include any of the exterior pockets until the outside material has been secured around the foam and the frame 700.

In some embodiments, the frame 700 may comprise a more durable material than plastic such as aluminum, steel, bulletproof metal, as non-limiting examples. For example, the frame may be enclosed with a bulletproof material that acts as a shield when traveling in case a life-threatening event were to occur. In some aspects, the frame 700 material may protect the contents of the bag as well as the person with the bag. In some embodiments, the frame 700 may have foam located on the interior to ensure that all contents inside are protected and safe from fall damage. In some embodiments, the frame 700 may be sealed with waterproof material to ensure that no materials inside are damaged from rain, flooding, or any other non-limiting example.

In some aspects, the frame 700 may comprise a center frame 760 comprising four connected rigid walls, and an outer frame 770 comprising at least two rigid walls configured to attach to at least a portion of the center frame 760. In some embodiments, a retractable strap system may comprise a retractable strap comprising a first end and a second end. In some implementations, a set of constant force springs 720 may be configured to control a set of positions of the retractable strap, wherein a first constant force spring 720 is connected to the first end and a second constant force spring 720 is connected to the second end. In some aspects, a set of frame mounts 725 may be configured to mount the set of constant force springs 720 to the center frame 760, wherein each frame mount 725 mounts each constant force spring 720 to the center frame 760, allowing a retractable strap to extend through the strap openings providing access to the retractable strap.

Figure 7B:
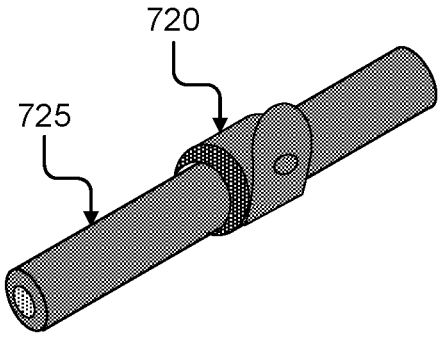
FIG. 7B illustrates an exemplary internal assembly for a bag with retractable strap, according to some embodiments of the present disclosure.
Figure 7C:
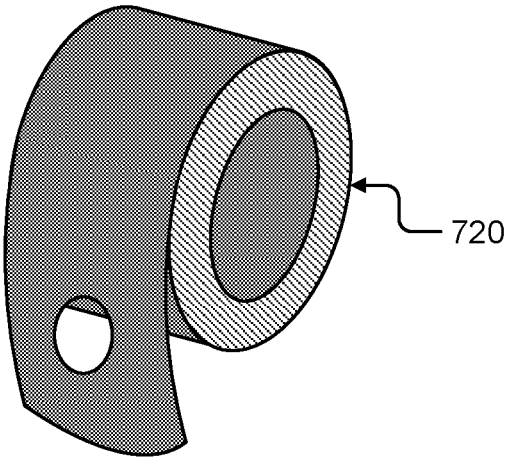
FIG. 7C illustrates an exemplary spool for an internal assembly for a bag with retractable strap, according to some embodiments of the present disclosure.
Figure 7D:
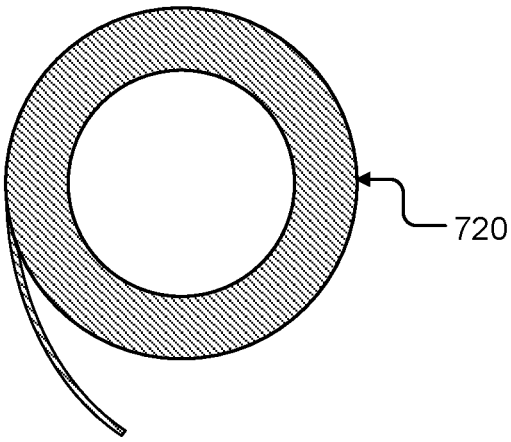
FIG. 7D illustrates an exemplary spool for an internal assembly for a bag with retractable strap, according to some embodiments of the present disclosure.

Referring now to FIG. 7B, an exemplary frame mount 725 for a constant force spring 720 is illustrated. Referring now to FIG. 7C, an exemplary constant force spring 720 for a bag with retractable strap is illustrated. Referring now FIG. 71), an exemplary constant force spring 720 for an internal assembly for a bag with retractable strap is illustrated.

In some embodiments, an internal constant force spring 720 may be used to retract the retractable strap 730 within the frame 700. In some aspects, the internal constant force spring 720 may allow for the retractable strap to be retracted. For example, the middle segment may be used to interface with the attachment mechanism 715 to connect to the retractable strap, whereas the distal areas of the internal constant force spring 720 may be used for rotation purposes with the frame mount 725.

In some aspects, the internal constant force spring 720 may be attached to a frame mount 725 connected to the outer frame 770 of the bag that may allow it to be rotated to retract the retractable strap into the bag, and allow the strap to extend from the internal constant force spring 720 to the outside of the frame 700. In some aspects, the retractable strap may comprise a hole or insertion mechanism at the distal end that may interface with the attachment mechanism 715. For example, the hole at the end of the retractable strap 730 may be fitted into a spot on the bag where it is then secured. In some implementations, a snapping system may be used on the end the retractable strap and placed somewhere on the outside of the bag so that the retractable strap may be attached to the bag and secured for use. In some embodiments, a hole at the end of the internal constant force spring 720 may secure the retractable strap to the internal constant force spring 720 via the attachment mechanism 715.

In some aspects, the retractable strap may comprise several different materials depending on the size, type, and quality of the bag the user orders. In some aspects, the internal constant force spring 720 may be different lengths and sizes depending on the size and shape of the bag. For example, the internal constant force spring 720 may be larger for larger bags so that it is easier to secure and fit around a larger bag. In some implementations, the material may be thicker or made with extra material to accommodate a larger bag.

Figure 8:
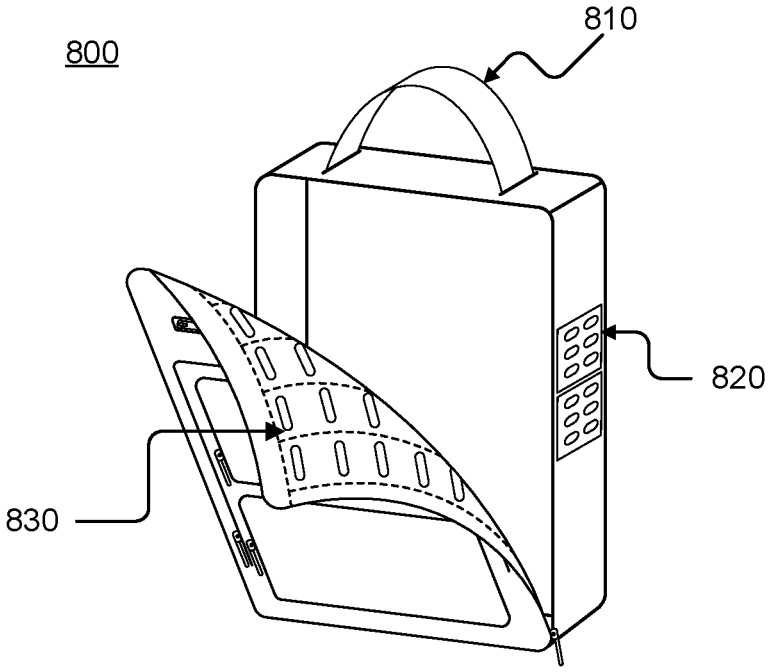
FIG. 8 illustrates an exemplary bag with a retractable strap, wherein the bag is partially open.

Referring now to FIG. 8, an exemplary bag 800 with a retractable strap 810, wherein the bag 800 is partially open is illustrated. In some aspects, a bag 800 may comprise an exterior accessory panel 820 and interior accessory panel 830. In some embodiments, accessory panels 820, 820 may comprise a MOLLE (Modular Lightweight Load-carrying Equipment) panel. In some implementations, the bag 800 may have an exterior accessory panel 820 which may hold and carry different objects on the outside. In some embodiments, the exterior accessory panel 820 may be a singular pocket to hold one or two objects at a time.

For example, the exterior accessory panel 820 may be used as a gun holster in open carry states, and the pocket may lock and secure the gun. In some aspects, an exterior accessory panel 820 may be located on either side, and/or on the back and front of the bag 800. In some embodiments, the exterior accessory panel 820 may come in different sizes and shapes based on the variation of the bag 800. In some implementations, the exterior accessory panel 820 may have a built-in locking mechanism which enables the user to lock each panel to secure all objects inside. In some aspects, the exterior accessory panel 820 may use a third-party locking system in which the panel has an access point for the lock to go through to secure the objects inside.

In some embodiments, the interior accessory panel 830 may be used to secure the objects inside the bag 800. In some implementations, the orientation of the interior accessory panel 830 may change based on the manufactured type of the bag 800. For example, the interior accessory panel 830 may have one or two singular pockets that hold bigger objects, or there may exist several small or medium size pockets to hold more objects at one time. In some implementations, the bag 800 may have a zipper system that helps close the interior of the bag up for travel and safe keeping. In some aspects, the zipper system may have the option to lock up the interior accessory panel 830 from being accessed by outside parties. For example, either zipper may have a connection to each other that locks into place using a key or code system that only the bag owner knows, keeping the contents inside of the bag 800 safe from theft. In some embodiments, other non-limiting types of enclosure mechanisms may be used to assist in closing the interior of the bag.

In some implementations, the interior accessory panel 830 may hold the same objects that the exterior accessory panel 820 can hold, and vice versa. In some embodiments, the interior accessory panel 830 may not be limited to one section of the interior of the bag. For example, interior accessory panel 830 may be located on any part of the interior of the bag. In some aspects, more than one interior accessory panel 830 may exist on the interior of the bag 800. In some implementations, the interior accessory panel 830 may be comprised of several Modular Lightweight Load-carrying Equipment (MOLLE) for practical and travel use. In some embodiments, the MOLLE may help carry larger items without damaging or compromising the interior and shape of the bag 800.

Referring now to FIG. 9A, an exemplary accessory panel 910 for a bag 900 with a retractable strap is illustrated. Referring now to FIG. 9B, an exemplary accessory 920 for a bag with a retractable strap is illustrated. Referring now to FIG. 9C, an exemplary accessory panel 910 with accessory 920, 925 for a bag 900 with a retractable strap is illustrated.

In some aspects, the accessory panel 910 may have the option to attach different accessories 920, 925 to the panel. In some aspects, there may be no limiting combination to which accessories 920, 925 can be added to the accessory panel 910 as long as the combination fits. In some embodiments, the accessories 920, 925 may be extra pockets or compartments, different weapons, charging cables, tablets, personal hygiene equipment, or any other non-limiting example that fits onto the accessory panel 910.

In some implementations, the accessory panel 910 may have a system that allows for objects to be added at will to the panel. In some embodiments, the accessories 920, 925 may be pockets added to the accessory panel 910 using a locking system. In some embodiments, the locking system may be a hook and loop attachment similar to Velcro, a hooking type system, magnets, or any other non-limiting example. For example, the hook and loop attachment on the accessory panel 910 may have Velcro-like on portions of the panel and the pockets may have Velcro-like material on the backside to connect and attach to the panel.

In some implementations, the accessories 920, 925 may be different sized and shaped pockets that allow for different sized objects to be carried at will. For example, a smaller accessory 920, 925 may be used to carry different types of charging cables whereas, the larger accessory 920, 925 may hold tablets or even food products. In some embodiments, the bag 900 may have different orientations of the accessories 920, 925 and the accessory panel 910 may come in different sizes and shapes.

In some aspects, the accessory panel 910 may accept a firearm holster that may be added and removed from the interior of the bag 900. In some embodiments, the accessory panel 910 may have the ability to attach more than one firearm holster at once or different sized firearm holster. For example, a larger firearm holster may be attached to the accessory panel 910, or multiple smaller firearm holsters may be attached to the accessory panel 910 at once. In some implementations, the limitation to the size of the firearm holster may be dependent on the size of the accessory panel 910.

Figure 10:
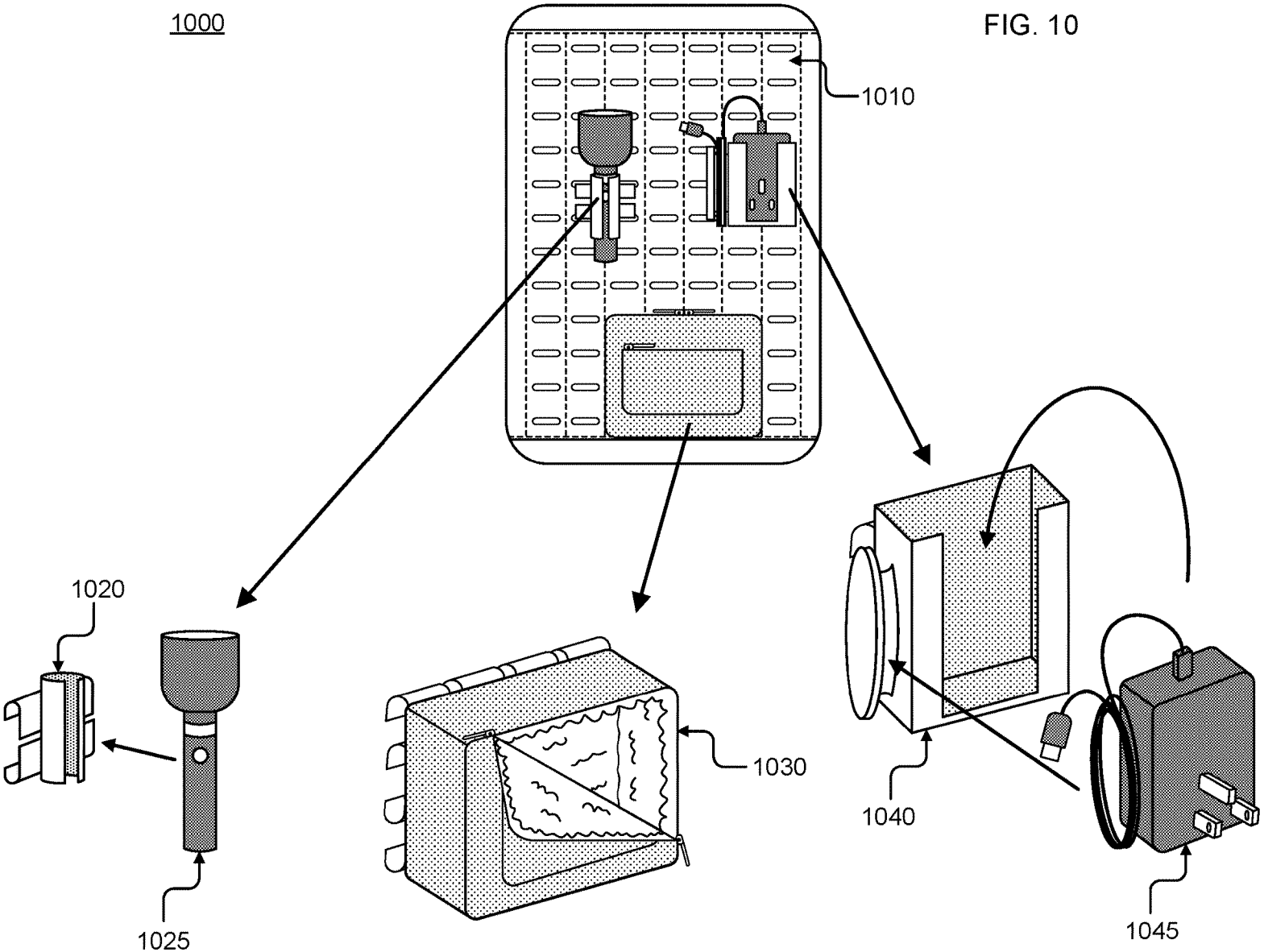
FIG. 10 illustrates an exemplary accessory panel and accessories for a bag with a retractable strap, according to some embodiments of the present disclosure.

Referring now to FIG. 10, an exemplary accessory panel 1010 and accessories 1020, 1030, 1040 for a bag 1000 with a retractable strap is illustrated. In some embodiments, the accessories 1020, 1030, 1040 may be customized based on the needs of a user, such as based on objects 1025, 1045 they would like to carry.

In some embodiments, the accessory panel 1010 may be used as a direct attachment system rather than a pocket system. For example, the accessories 1020, 1030, 1040 may be directly attached to accessory panel 1010 inside the bag 1000. In some aspects, the accessories 1020, 1030, 1040 may be different objects that the user of the bag 1000 may need on a daily basis or for travel. In some implementations, the user may customize the accessory panel 1010 to carry their basic needs.

In some aspects, the accessories 1020, 1030, 1040 may be different objects that fit in the bag 1000 for travel and everyday use. For example, the objects may include things like a flashlight, chargers, keys, coolers, and other non-limiting examples. In some implementations, the attachments for the accessory panel 1010 may all be similar to attach the accessories 1020, 1030, 1040. In some embodiments, each accessory 1020, 1030, 1040 may have their own attachment system rather than the same attachment for each accessory 1020, 1030, 1040. For example, a cooler may have a larger attachment different from a flashlight or car keys which may have smaller attachments.

In some aspects, the bag 1000 may have an insulated interior to keep food and beverages colder. In some embodiments, a cooler may be kept inside the bag 1000 and the food or beverages inside may be kept cold longer for better preservation. In some implementations, the attachment systems may be different shapes to attach different objects. For example, a circular attachment may be used for a flashlight whereas, a charger may have a square or rectangular attachment to hold it in place on the accessory panel 1010.

Figure 11A:
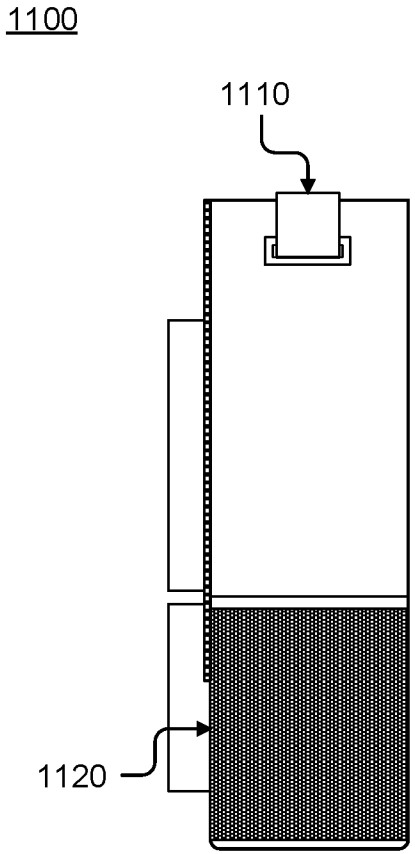
FIG. 11A illustrates an exemplary accessory panel for a customizable bag with a retractable strap, according to some embodiments of the present disclosure.
Figures 11B, 11C:
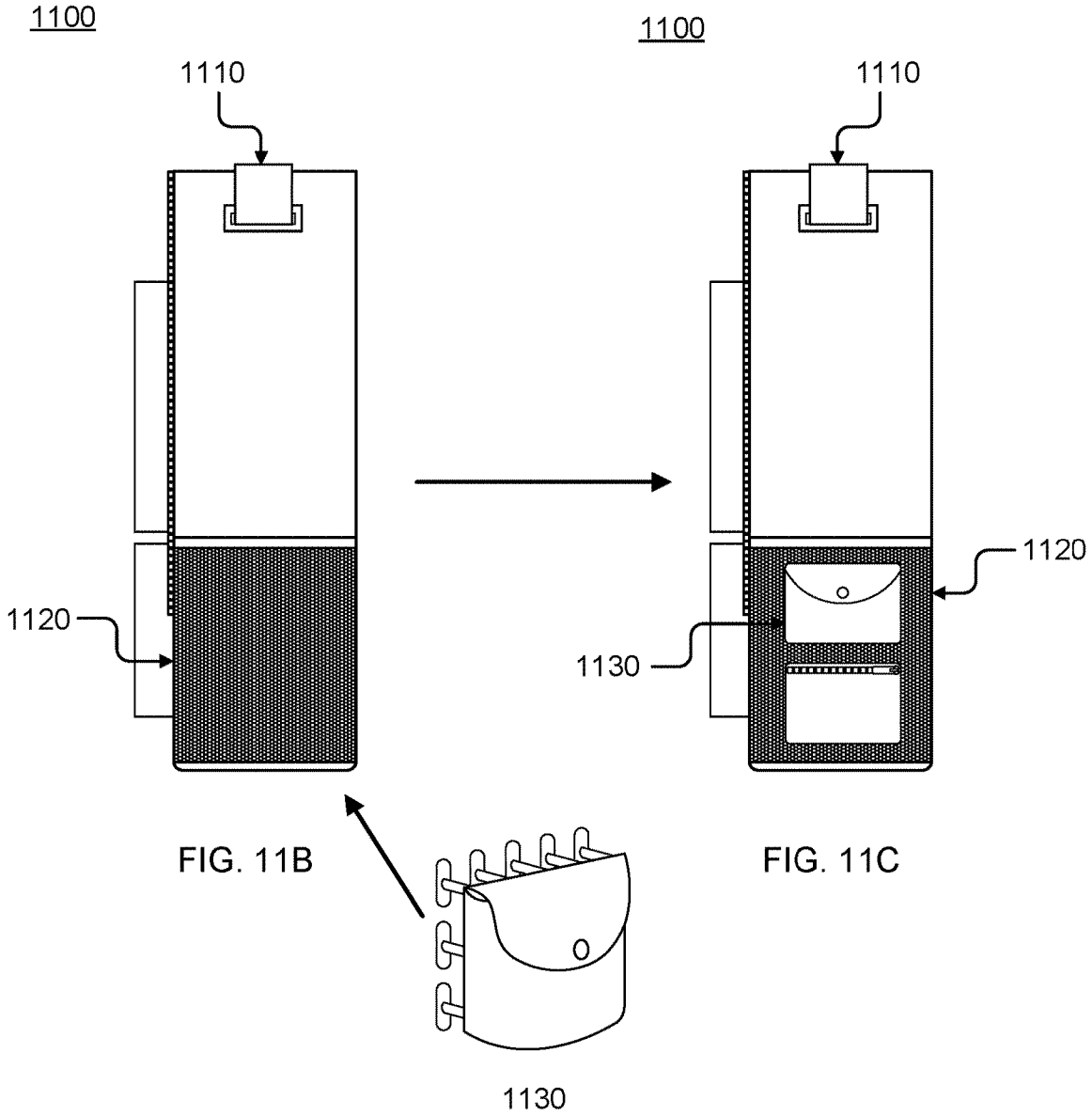
FIG. 11B illustrates an exemplary accessory for a bag with a retractable strap, according to some embodiments of the present disclosure.
FIG. 11C illustrates an exemplary accessory panel with accessory for a bag with a retractable strap, according to some embodiments of the present disclosure.

Referring now to FIG. 11A, an exemplary accessory panel 1120 for a bag 1100 with a retractable strap 1110 is illustrated. Referring now to FIG. 11B, an exemplary accessory 1130 for a bag 1100 with a retractable strap 1110 is illustrated. Referring now FIG. 11C, an exemplary accessory panel with accessory 1130 for a bag 1100 with a retractable strap 1110 is illustrated.

In some implementations, the bag 1100 may have an accessory panel 1120 on the exterior to secure additional items for quick access. In some embodiments, the accessory panel 1120 may have a locking system to where the objects being held can be secured from thieves and from falling out and being lost. In some aspects, an accessory 1130 may be placed on the interior or exterior of the accessory panel 1120. In some implementations, the accessory 1130 may have an attachment system which allows it to be attached to the outside of the accessory panel 1120.

In some embodiments, the accessory 1130 may have its own locking system. For example, when the accessory 1130 is attached to the exterior of the accessory panel 1120 then the accessory may lock, securing the contents inside. In some implementations, the accessory 1130 may be secured inside the accessory panel 1130. In some aspects, the accessory panel 1120 may have its own locking and securing system that allows for the contents inside to be safe. For example, accessories may be placed inside the accessory panel 1120 and from there the user can lock and secure the contents inside using a built-in or third-party locking system.

In some embodiments, the accessory panel 1120 may be located at the bottom of the bag 1100. In some implementations, the accessory panel 1120 may not be limited to just one location on the bottom of the bag 1100. For example, the accessory panel 1120 may be located on the entirety of the bottom of the bag 1100, either side, both sides, all sides, or on either the front or the back of the bag 1100. In some aspects, the outside of the accessory panel 1120 may be made of a strong material that allows for the attachment of an accessory 1130. For example, the entirety of the accessory panel 1120 may be made up of hook and loop attachment so that the different accessories and attachments can be added and taken away easily.

In some implementations, the retractable strap 1110 may hold a limited number of attachments 1130 when fully extended. For example, the attachments may be wrapped around the extended strap to provide the user with extra carrying space when in use. In some aspects, the attachments may be a phone or key holder for quick access to more immediate things, rather than reaching in the bag 1100 or their pocket. In some embodiments, a magnetic strip may be built into the retractable strap 1110 to hold magnetic things while being used. For example, the user may attach their keys to the magnetized retractable strap 1110 and this may keep their keys secure during travel or when in use.

Figure 12A:
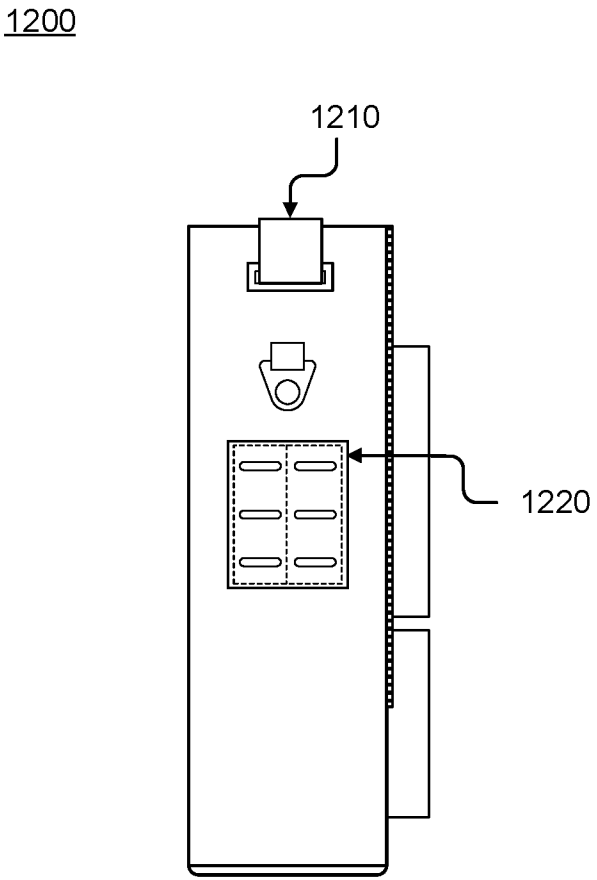
FIG. 12A illustrates an exemplary accessory panel for a bag with a retractable strap, according to some embodiments of the present disclosure.
Figure 12C:
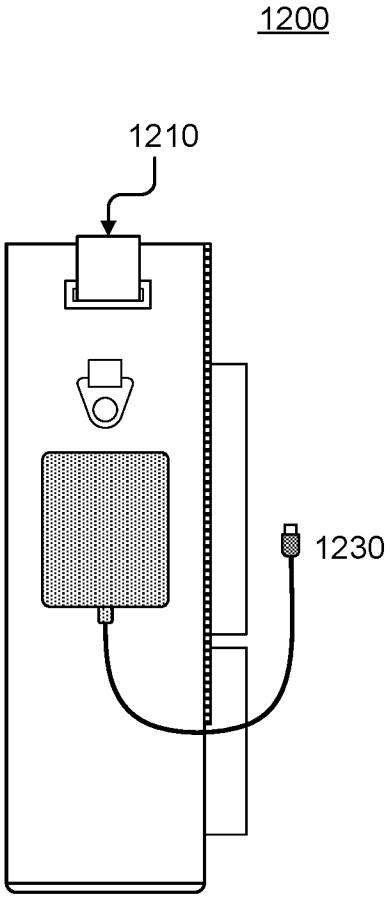
FIG. 12C illustrates an exemplary accessory panel with accessory for a bag with a retractable strap, according to some embodiments of the present disclosure.
Figure 12B:
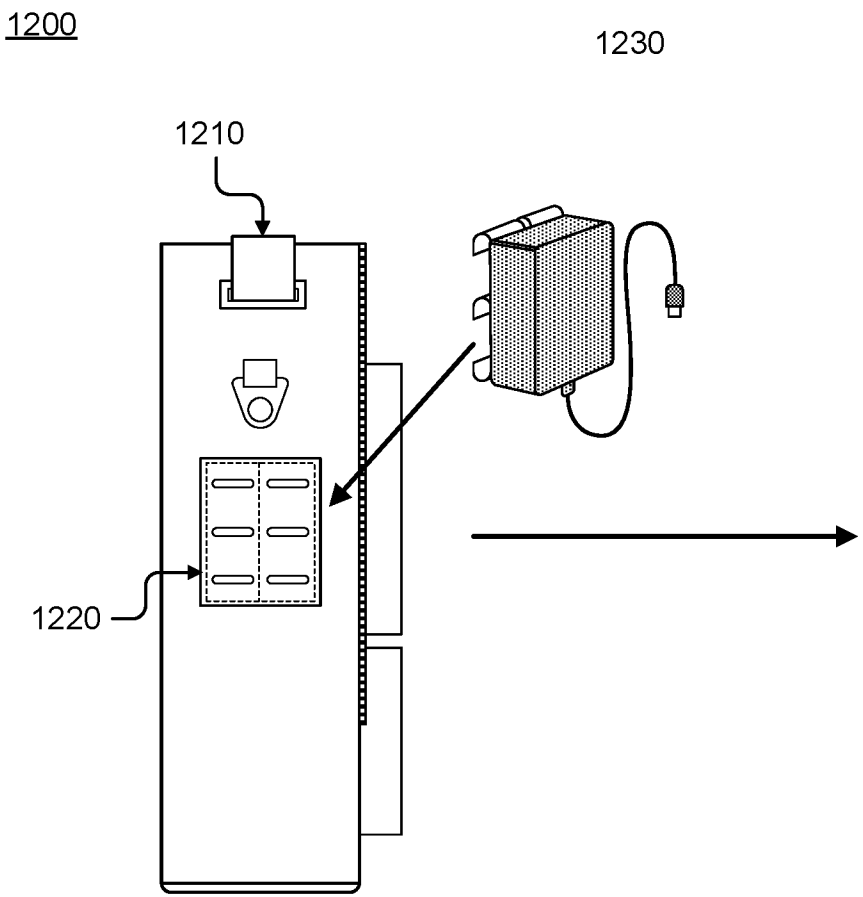
FIG. 12B illustrates an exemplary accessory for a bag with a retractable strap, according to some embodiments of the present disclosure.

Referring now to FIG. 12A, an exemplary accessory panel 1220 for a bag 1200 with a retractable strap 1210 is illustrated. Referring now to FIG. 12B, an exemplary accessory 1230 for a bag 1200 with a retractable strap 1210 is illustrated. Referring now to FIG. 12C, an exemplary accessory panel 1220 with accessory 1230 for a bag 1200 with a retractable strap 1210 is illustrated.

In some embodiments, a smaller version of the accessory panel 1220 may located on one side of the bag 1200. In some implementations, this version may be used to attach smaller singular accessories 1230. For example, a portable charging port may be attached to the accessory panel 1220 for quick charging to their mobile devices. In some aspects, the accessory panel 1220 may not be required to have an accessory 1230 attached at all times. In some embodiments, a modular battery pack may be attached but does not have to be charging a mobile device at all times for the device to be attached.

In some implementations, a small clip device may be attached to the accessory panel 1220 on the side of the bag 1200 to hold smaller documentation items. For example, a smaller bag-like carrying device may be clipped onto the accessory panel 1220 to carry boarding passes, passports, wallets, and other non-limiting examples. In some embodiments, the bag 1200 may have a cable managements system located in the surrounding area of the accessory panel 1230. For example, when cables are plugged into a modular battery the bag 1200 may control where the cables are to prevent them from becoming detached or tangled.

In some implementations, the cable management system may allow the charging cables to go up the retractable strap 1210 and allow mobile devices to attach to the retractable strap. For example, the mobile device may be attached to the retractable strap 1210 and the cable may wind upward from the accessory panel 1220, keeping the charging hands free and the cables easier to manage while traveling. In some implementations, a modular battery may be built into the bag 1200 with retractable charging cables. For example, opposite side of the accessory panel 1220 on the bag 1200 a modular battery may exist with cables that retract similar to the retractable strap 1210.

In some aspects, the accessory panel 1220 may have different attachments to help the user attach different objects onto the device rather than just the modular battery or charger. For example, a square attachment may be used to connect the battery to the accessory panel, whereas several small circular attachments may be used to attach different keychains or cosmetic accessories to the bag, allowing for full customization.

Figure 13B:
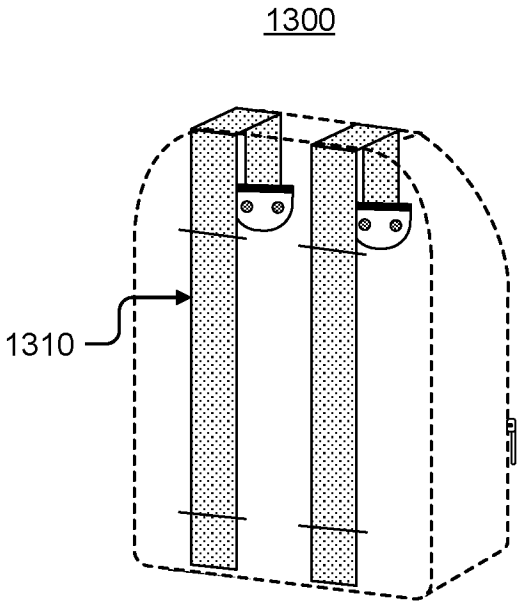
FIG. 13B illustrates an exemplary bag with retractable straps that may be in separate retractable systems, according to some embodiments of the present disclosure.
Figure 13A:
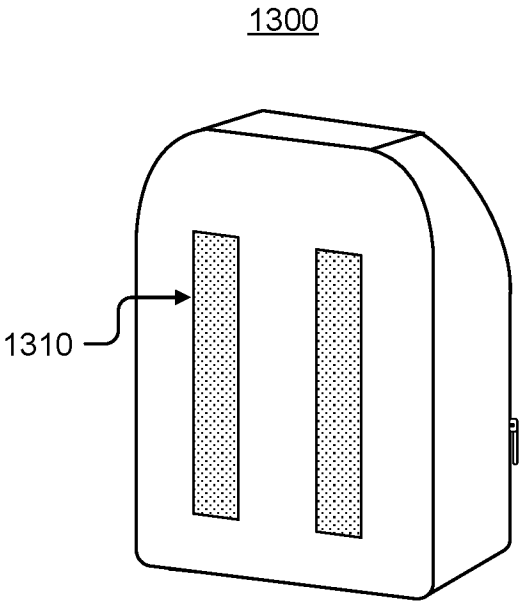
FIG. 13A illustrates an exemplary bag with retractable back straps that may be in the same retractable system, according to some embodiments of the present disclosure.

Referring now to FIG. 13A-B illustrates an exemplary bag 1300 with rear retractable straps 1310 that may be in the same retractable system. In some embodiments, the bag 1300 may comprise retractable straps 1310 on the posterior side of the bag 1300 that may be used to transport the bag 1300. In some implementations, the retractable straps 1310 may operate as previously described. In some embodiments, the retractable straps 1310 may be stored inside individual pockets when the bag 1300 is not in use.

For example, the retractable straps 1310 may have individual pockets closed off with zippers once they have been retracted into the bag 1300, and this may protect the straps 1310 from damage. In some implementations, the retractable straps 1310 may be on different constant force springs. For example, each retractable strap 1310 may be retracted and used separately rather than jointly. In some aspects, the retractable straps 1310 may be stored in one pocket rather than separate pockets. For example, one larger pocket may be located on the backside of the bag 1300 that stores both straps 1310 once they have been retracted and are no longer in use. In some embodiments, the retractable straps 1310 may be made of the same material as the other variations of the strap 1310.

In some implementations, the bag 1300 may have a hook used for storage or carriage. In some aspects, the hook may retract into the bag 1300 when not in use. As an illustrative example, the hook and the retractable straps 1310 may be on constant force springs that help retract the objects into the bag 1300 when not in use. In some embodiments, the hook may be used while the retractable straps 1310 are in use. In some implementations, the hook may be used to attach different objects for carry. For example, a pair of keys may be attached to the hook when the bag 1300 is in use.

Figure 14B:
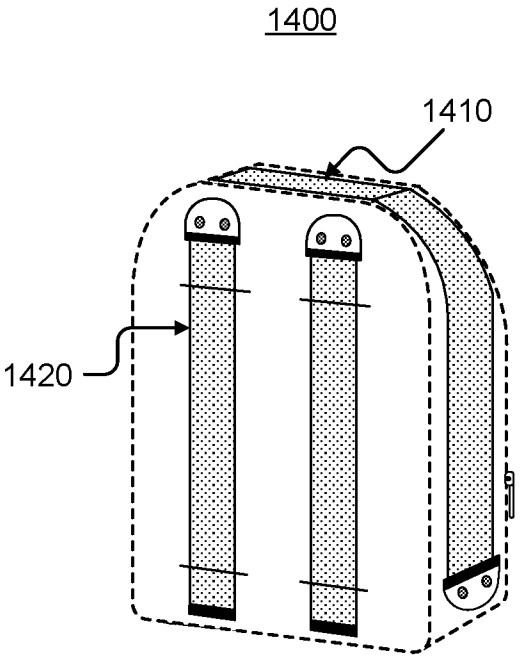
FIG. 14B illustrates exemplary back straps and top retractable strap with different retraction mechanisms, according to some embodiments of the present disclosure.
Figure 14A:
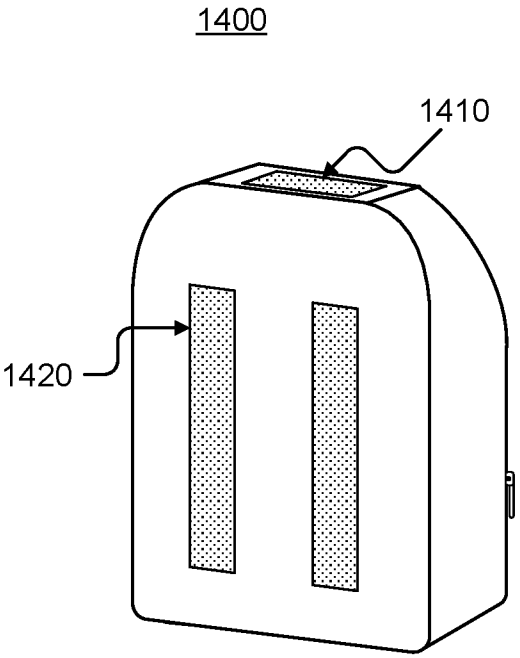
FIG. 14A illustrates an exemplary bag with both the retractable strap at the top and the retractable back straps on the same retraction mechanism, according to some embodiments of the present disclosure.

FIG. 14A illustrates an exemplary bag 1400 with both the retractable strap 1410 at the top and the rear retractable straps 1420 on the same retraction mechanism. FIG. 14B illustrates exemplary back retractable straps 1420 and top retractable strap 1410 with different retraction mechanisms. In some aspects, the bag 1400 may contain the backside retractable straps 1420 in addition to the retractable strap 1410 located on the topside of the bag 1400. In some embodiments, the retractable strap 1410 on the topside of the bag 1400 may change orientation per user preference.

For example, despite the backside retractable straps 1410 the topside strap 1410 may still transfer to either side of the bag 1400 to change for a different orientation. In some implementations, the backside retractable strap 1410 may not need to be retracted for the use of the topside version.

In some embodiments, the top retractable strap 1410 may not be able to move orientation because of the backside retractable straps 1410. In some implementations, the retractable straps 1410 may be on separate constant force springs. For example, the backside retractable strap 1410 may be on a separate constant force spring from the topside strap 1410, and this may allow them to retract and extract at different times. In some aspects, despite the separate constant force springs may allow for a more fluid flow of each strap 1410. For example, the orientation of the topside retractable strap 1410 may be changed easier than if all straps 1410 were in the same constant force spring because it may move freely without being connected to another strap 1410.

Figure 15B:
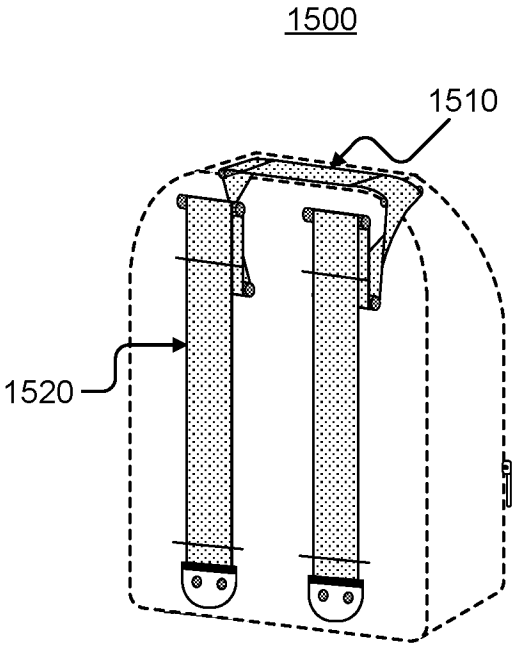
FIG. 15B illustrates exemplary retraction mechanisms, according to some embodiments of the present disclosure.
Figure 15A:
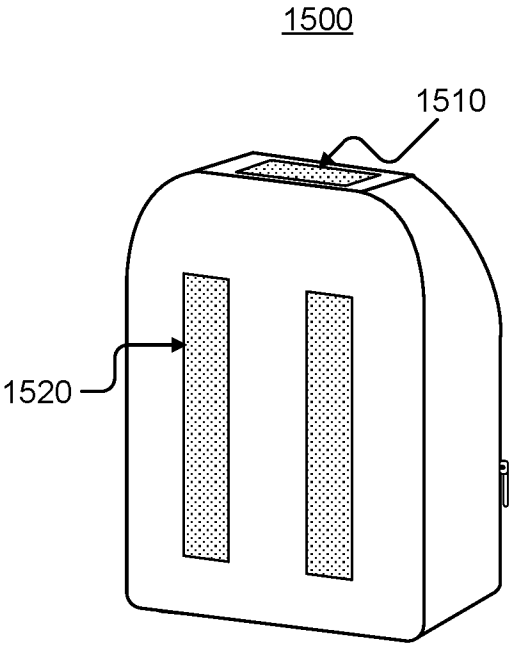
FIG. 15A illustrates an exemplary bag with both the retractable strap at the top and the retractable back straps on different retraction mechanisms, according to some embodiments of the present disclosure.

FIGS. 15A-B illustrates an exemplary bag 1500 with both the retractable strap 1510 at the top and the retractable back straps 1520 on different retraction mechanisms. FIG. 15B illustrates just the back straps 1520 and top retractable strap 1510 and how they may be intertwined on the same retraction mechanism.

In some implementations, the bag 1500 may have the backside and topside retractable straps 1510 on the same constant force spring. In some aspects, all retractable straps 1510 may need to be removed at once to adjust the orientation of the bag 1500. In some embodiments, the bag 1500 may have individual pockets that each retractable strap 1510 resides in. For example, the left backside strap 1520 may go into a different pocket from the right backside strap 1520, and both of those may be separate from the topside strap 1510.

In some implementations, the pockets may preserve the retractable straps 1510 from possible damage from travel, weather, and other non-limiting examples. In some implementations, the backside retractable straps 1520 may be connected internally to the underside of the topside strap 1510. In some embodiments, the retractable straps 1510 on the backside may have connection points along the length of the straps 1520 to connect with the topside retractable strap 1510. For example, there may be a connection point at the top of both backside straps 1520, the middle and the bottom securing all retractable straps 1510 on one constant force spring.

In some aspects, the constant force spring that connects all the retractable straps 1510 may be a closed system. In some implementations, the constant force spring that connects all the retractable straps 1510 may be an open system. For example, the constant force spring may be connected on each end to itself or another part of the retractable strap 1510, or the system may not be connected to anything inside and is free to move about on the interior of the bag 1500. In some embodiments, each backside retractable strap 1510 may have a separate connection from each other but connect to the topside retractable strap 1510. In some implementations, even though the connections may be different all the retractable straps 1510 may be on the same constant force spring.

Figure 16:
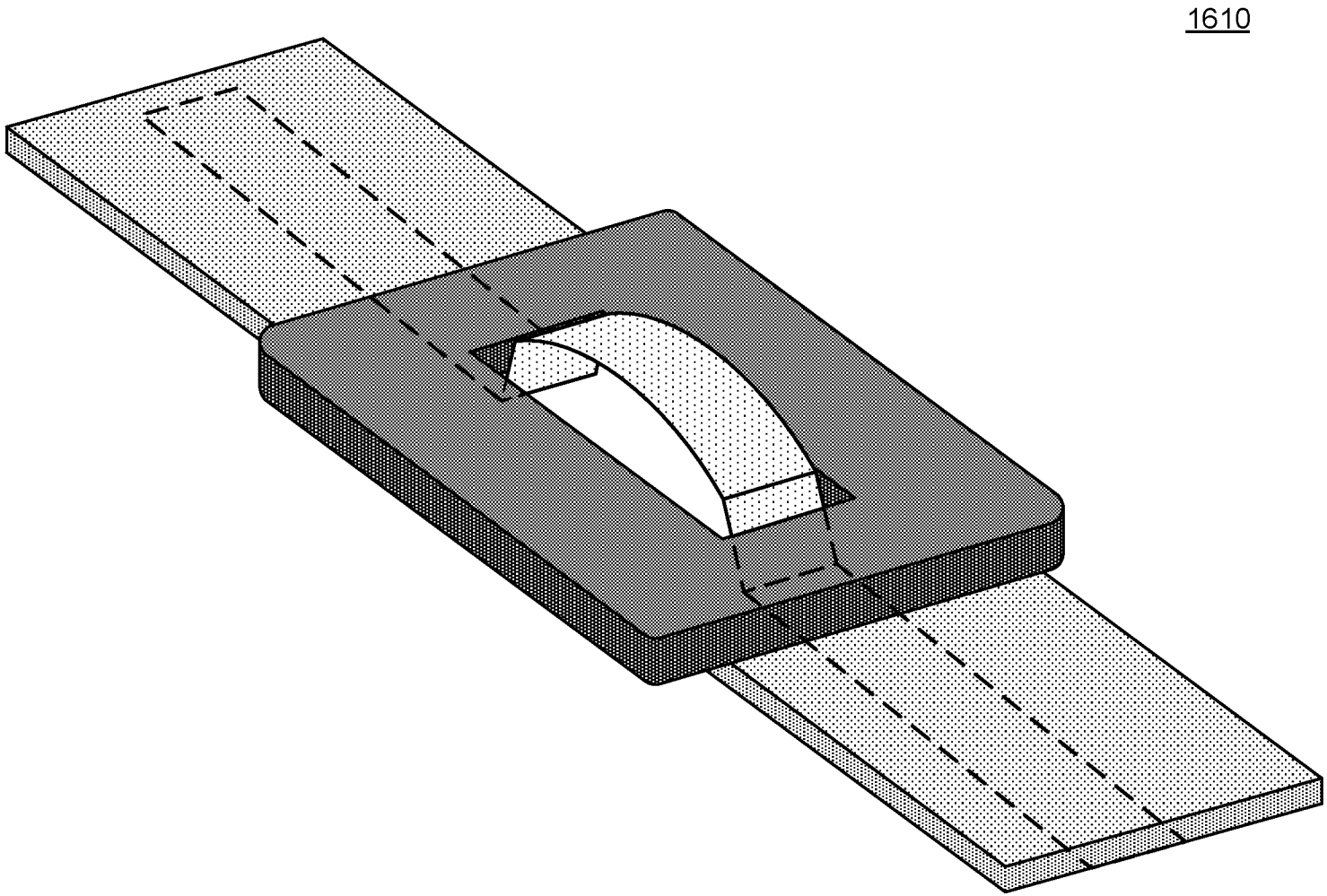
FIG. 16 illustrates an exemplary handle for a bag with retractable straps, according to some embodiments of the present disclosure.
Figure 17C:
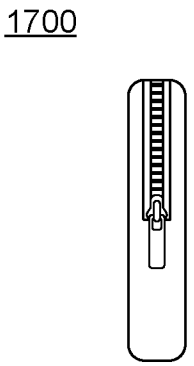
FIG. 17C illustrates an exemplary accessory for use with a bag with retractable straps, according to some embodiments of the present disclosure.
Figure 17B:
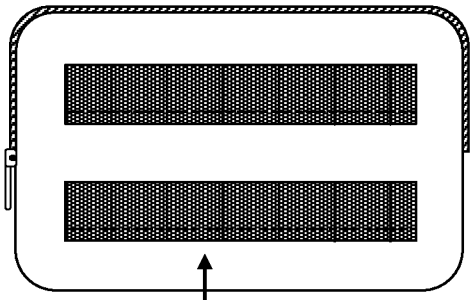
FIG. 17B illustrates an exemplary accessory for use with a bag with retractable straps, according to some embodiments of the present disclosure.
Figure 17A:
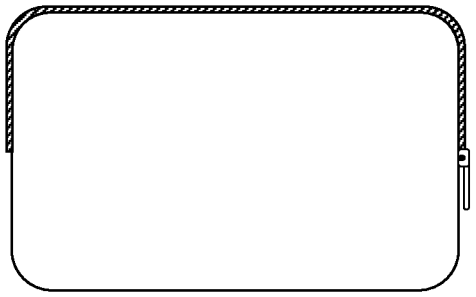
FIG. 17A illustrates an exemplary accessory for use with a bag with retractable straps, according to some embodiments of the present disclosure.
Figure 17E:
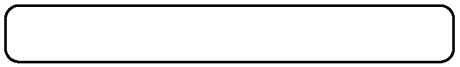
FIG. 17E illustrates an exemplary accessory for use with a bag with retractable straps, according to some embodiments of the present disclosure.
Figure 17D:
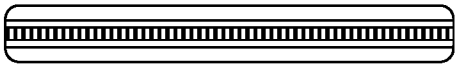
FIG. 17D illustrates an exemplary accessory for use with a bag with retractable straps, according to some embodiments of the present disclosure.

Referring now to FIG. 16, an exemplary handle 1610 for a bag with retractable straps. In some aspects, the handle 1610 may be pulled up and locked into place from the exemplary bag when being used. For example, the handle may be pulled to the desired length and then be locked into place once held or secured by the user. In some embodiments, the bag may have a mechanism that senses when the handle 1610 needs to be locked into place after a small portion of time.

In some implementations, the handle 1610 may comprise an internal spool system on either side. For example, rather than one spool system at the end of the handle 1610, each end of the handle 1610 may have its own spool system in case one gets stuck or jammed during retraction. In some embodiments, the handle 1610 may need to be pulled all the way out by the user before retraction can happen.

In some implementations, the top of the handle 1610 may be made up of a different padded material than the rest of the device. For example, the part of the handle 1610 that the user grabs or puts on their shoulder may be padded, whereas the outer material may comprise a thinner, lightweight material so that it may glide in and out of the bag. In some implementations, the material around the opening of the handle 1610 may be indented so that it is easily accessible when the user is trying to grab it from inside the bag.

Referring now to FIGS. 17A-17E, an exemplary accessory 1700 for use with a bag with retractable straps 1710 is illustrated. In some aspects, the accessory 1700 may be similar to a laptop bag or small briefcase that may be attached to a bag. In some embodiments, the accessory 1700 may comprise a separate retractable strap 1710, which may convert the accessory into a standalone purse or clutch.

In some implementations, the accessory 1700 may have a zipper system used to open and close the device. In some aspects, the zipper system may have a locking mechanism that helps secure all of the contents that are inside the accessory 1700. In some embodiments, the zipper system may only cover half of the accessory 1700 to keep the bottom half intact so that the interior contents have a foundation to be secured in. In some implementations, the accessory 1700 may have a button-closure or snap-closure system to open and close the device.

In some aspects, the accessory 1700 may be waterproof. In some aspects, the securing mechanism may be magnetic rather than a zipper mechanism for quicker access. In some embodiments, the accessory 1700 may be placed into a special pocket or attached to an accessory panel within the bag. In some implementations, the accessory 1700 may have separate hook and loop attachments from the retractable straps 1710 that may be used to attach to the interior or exterior of the exemplary bag. For example, the hook and loop system may be attached to one of the handles or straps 1710 on the exterior of the bag or may allow for the accessory 1700 to be clipped on the interior of the bag.

In some aspects, the exterior of the accessory 1700 may be padded for extra protection of the interior contents. In some embodiments, the padding may protect the accessory 1700 itself from fall damage and other possible damage to the exterior of the device. In some embodiments, the accessory 1700 may be made up of different materials; including but not limited to bulletproof material, mesh, polyester, and other non-limiting examples.

Figure 18:
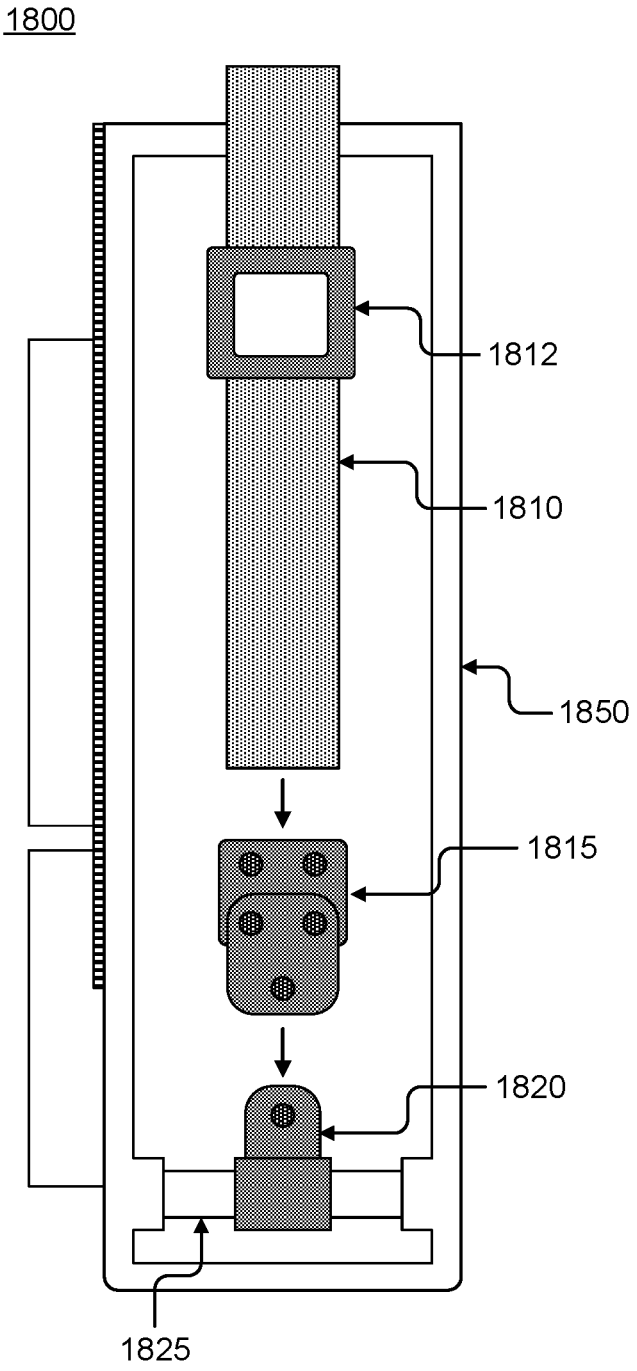
FIG. 18 illustrates an exemplary bag with an attachment mechanism, according to some embodiments of the present disclosure.
Figure 19A:
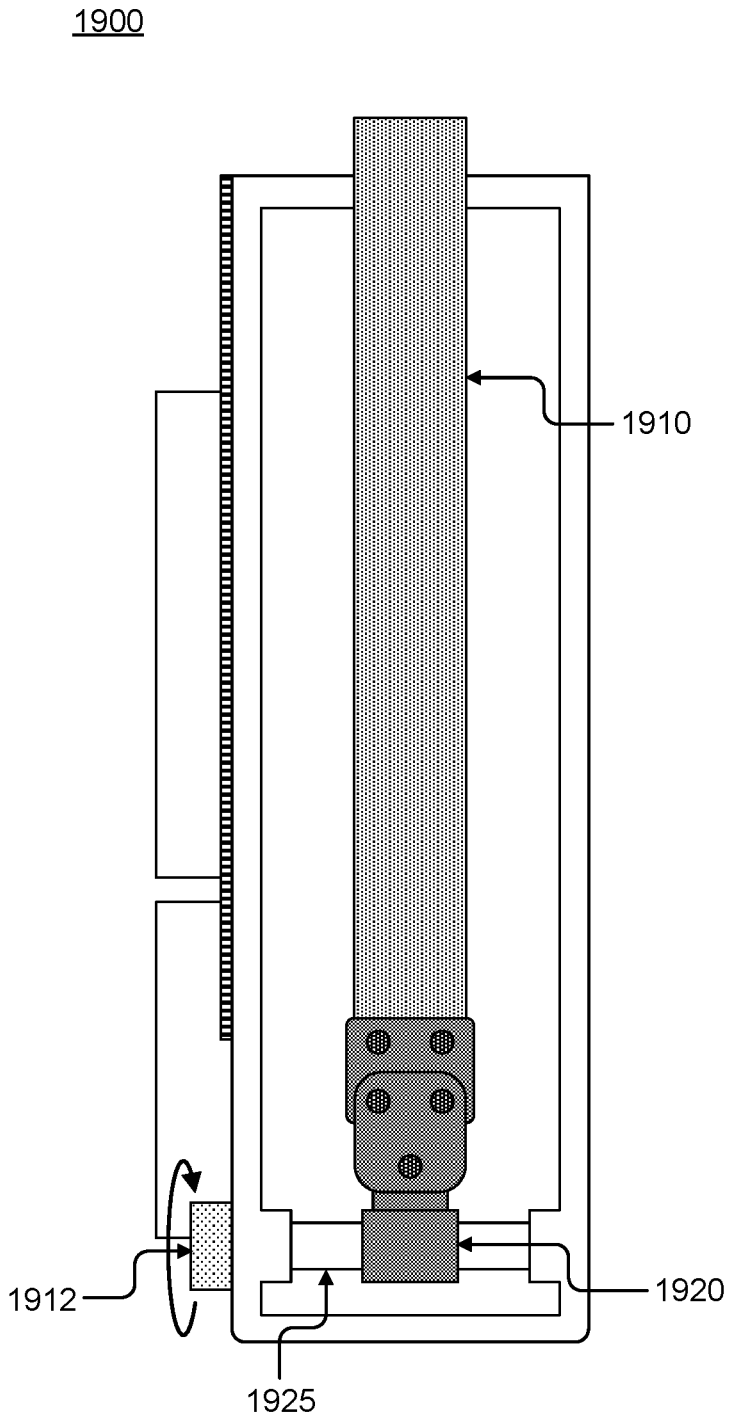
FIG. 19A illustrates an exemplary bag with an adjustment mechanism, according to some embodiments of the present disclosure.
Figure 19B:
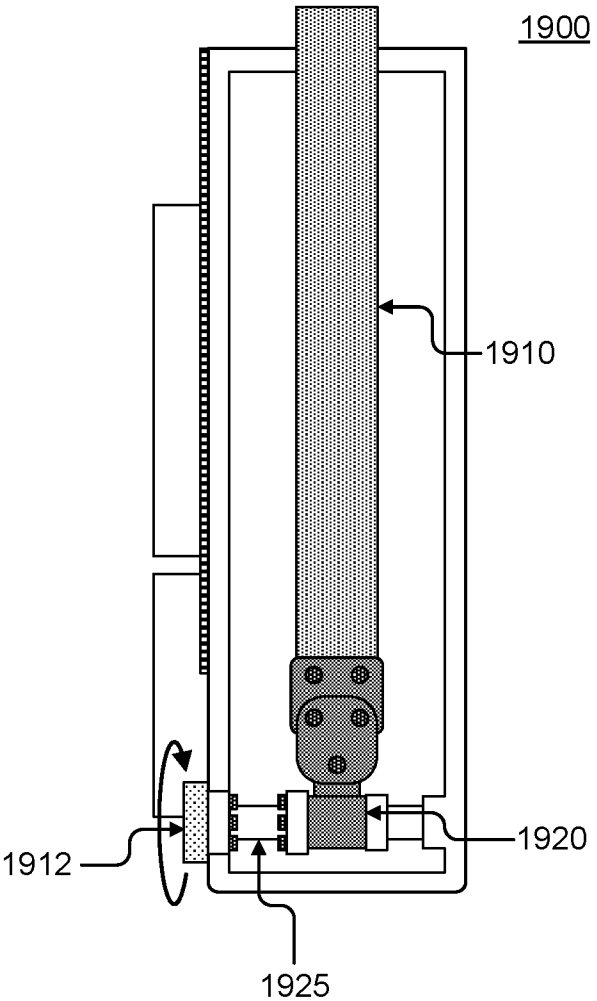
FIG. 19B illustrates an exemplary bag with an adjustment mechanism, according to some embodiments of the present disclosure.
Figure 19C:
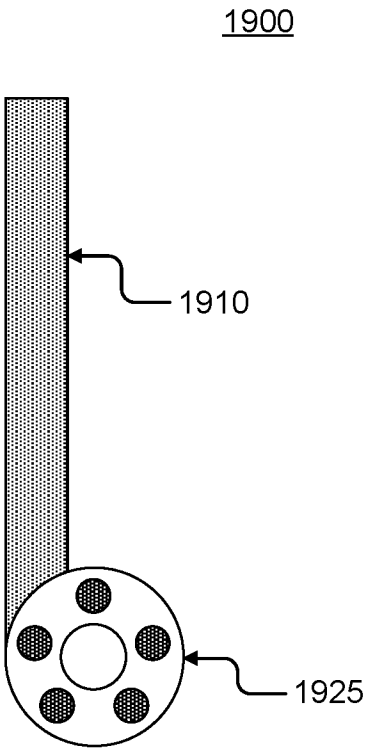
FIG. 19C illustrates an exemplary bag with an adjustment mechanism, according to some embodiments of the present disclosure.
Figure 19D:
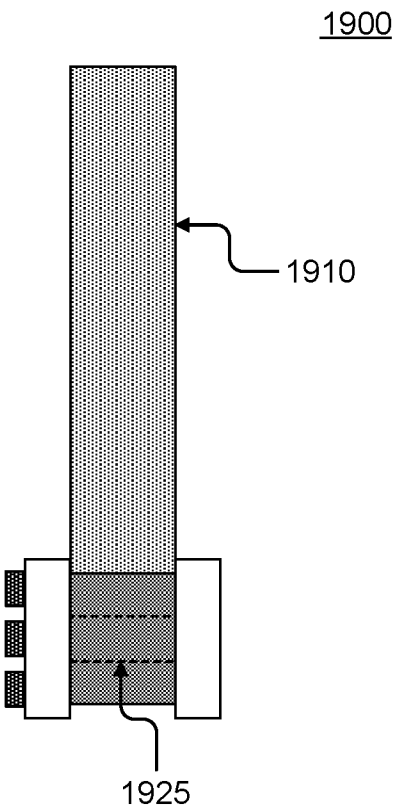
FIG. 19D illustrates an exemplary bag with an adjustment mechanism, according to some embodiments of the present disclosure.

Referring now to FIG. 18, an exemplary bag 1800 is illustrated. In some aspects, the bag may comprise a retractable strap 1810, wherein the strap may be adjusted using the constant force spring 1820. The use of a constant force spring 1820 may allow the retractable strap to function with a constant force. Extension of a constant force spring 1820 may reduce the probability of plastic deformation in the spring of the retractable strap 1810 which, in turn, may provide a constant retention force for the retractable strap 1810.

In contrast, common forms of retractable straps may comprise a plurality of springs that extend in the linear direction of movement. Due to the nature of a conventional spring, these springs would exert a variable resistance on the retractable strap 1810 with the full extension of the retractable strap 1810 comprising the highest resistance in an extension cycle. Through cyclical extension of the retractable strap 1810, these linear springs would eventually result in plastic deformation of the spring, thereby reducing the utility and retention of the retractable strap 1810. In some embodiments, the bag 1800 may comprise an attachment mechanism 1815, wherein the retractable strap 1810 and constant force spring 1820 may be connected.

In some implementations, the attachment mechanism 1815 may be located centrally between the retractable strap 1810 and the constant force spring 1820, wherein the components may be connected to create a constant force. In some aspects, the constant force spring 1820 may attach to the retractable strap 1810 via the attachment mechanism 1815. In some embodiments, the spring mechanisms 1820 may be removed from the attachment mechanism 1815. This may allow for replacement and interchangeability of constant force springs 1820.

For example, the constant force spring 1820 may clip onto an extruded portion of the attachment mechanism 1815, wherein the constant force spring 1820 may be attached at the exposed end of the curled up constant force spring. The interior end may be attached to the frame mount 1825 that connects to the inner frame 1850 of the bag 1800. Through this method of attachment, the constant force spring 1820 may uncurl as the retractable strap 1810 is extended, with the curling tendency of the constant force spring applying a constant retractive force.

As an illustrative example, the attachment mechanism 1815 may comprise one indentation on the bottom half, wherein the constant force spring 1820 may attach. The upper half of the attachment mechanism may comprise two indentations, wherein the retractable strap 1810 may be connected when in use. In some implementations, the attachment mechanism 1815 may provide a connection point for the constant force spring 1820 and the retractable strap 1810, whereby a constant force from the constant force spring 1820 to the retractable strap 1810 is implemented.

In some aspects, the fittings on the interior of the bag 1800 may be moved from the bottom of the bag 1800 to three quarters up the side of the bag 1800, wherein the retractable strap 1810 length may comprise a greater length because the constant force spring 1820 is located higher up on the bag 1800. The constant force spring 1820 may comprise a plurality of lengths, wherein the connected retractable strap 1810 may comprise a plurality of lengths corresponding to the length of the constant force spring 1820.

In some embodiments, the retractable strap 1810 may comprise an adjustment mechanism 1812 that may allow the length of the retractable strap 1810 to be modified. In some implementations, the adjustment mechanism 1812 and the attachment mechanism 1815 may operate as a stopper to reduce the length of the retractable strap 1810 by preventing further extension of the retractable strap 1810 from the bag 1800.

Referring now to FIG. 19A-D, an exemplary bag 1900 is illustrated. In some aspects, the bag 1900 may comprise an adjustment mechanism 1912. In some embodiments, the adjustment mechanism 1912 may be connected to the constant force spring 1920. In some implementations, the adjustment mechanism 1912 may be turned, wherein the torsional force of the constant force spring 1920 may be altered.

For example, the adjustment mechanism 1912 may be turned clockwise to create a stronger constant force between the retractable strap 1910 and the constant force spring 1920. The adjustment mechanism 1912 may be turned counter-clockwise to reduce the constant force between the retractable strap 1910 and the constant force spring 1920. The change in tension may be produced by modifying horizontal compression of the constant force spring from the frame mount 1925 or increasing the degree of rotation of the constant force spring 1920 around the frame mount 1925, as non-limiting options.

In some aspects, the adjustment mechanism 1912 may be pressed inward, whereby the force between the retractable strap 1910 and the constant force spring 1920 is released to resume the original constant force. In some embodiments, the retractable strap 1910 may move freely in the bag 1900 when the force from the constant force spring 1920 is released. Compressing the adjustment mechanism 1912 may disengage the retention mechanism exerting the predetermined resistance on the constant force spring 1920.

In some implementations, the adjustment mechanism 1912 may comprise a frame mount 1925, whereby the adjustment mechanism 1912 the constant force spring 1920 are connected. In some aspects, the frame mount 1925 and a constant force spring 1920 housing may comprise magnets. In some embodiments, the magnets may create a resistive force, wherein the adjustment mechanism 1912 may alter the constant force exerted by the constant force spring 1920.

As an illustrative example, the magnets may comprise opposite polarities, wherein the adjustment mechanism 1912 may be turned to increase the magnetic resistance between the frame mount 1925 and the constant force spring 1920 housing by altering the proximity of the resistant magnetism. The constant force between the two components may exert an additional constant force on the force exerted by the constant force spring 1920 on the retractable strap 1910.

In some implementations, the constant force being applied from the frame mount 1925 to the constant force spring 1920 may reduce cyclical fatigue on the constant force spring by allowing the magnets to assist in providing resistive force to the retractable strap 1910. These methods of constant force application may be unfeasible with a traditional linear spring system due to the necessity of a rotational resistance system as provided by a constant force spring 1920.

Figure 20:
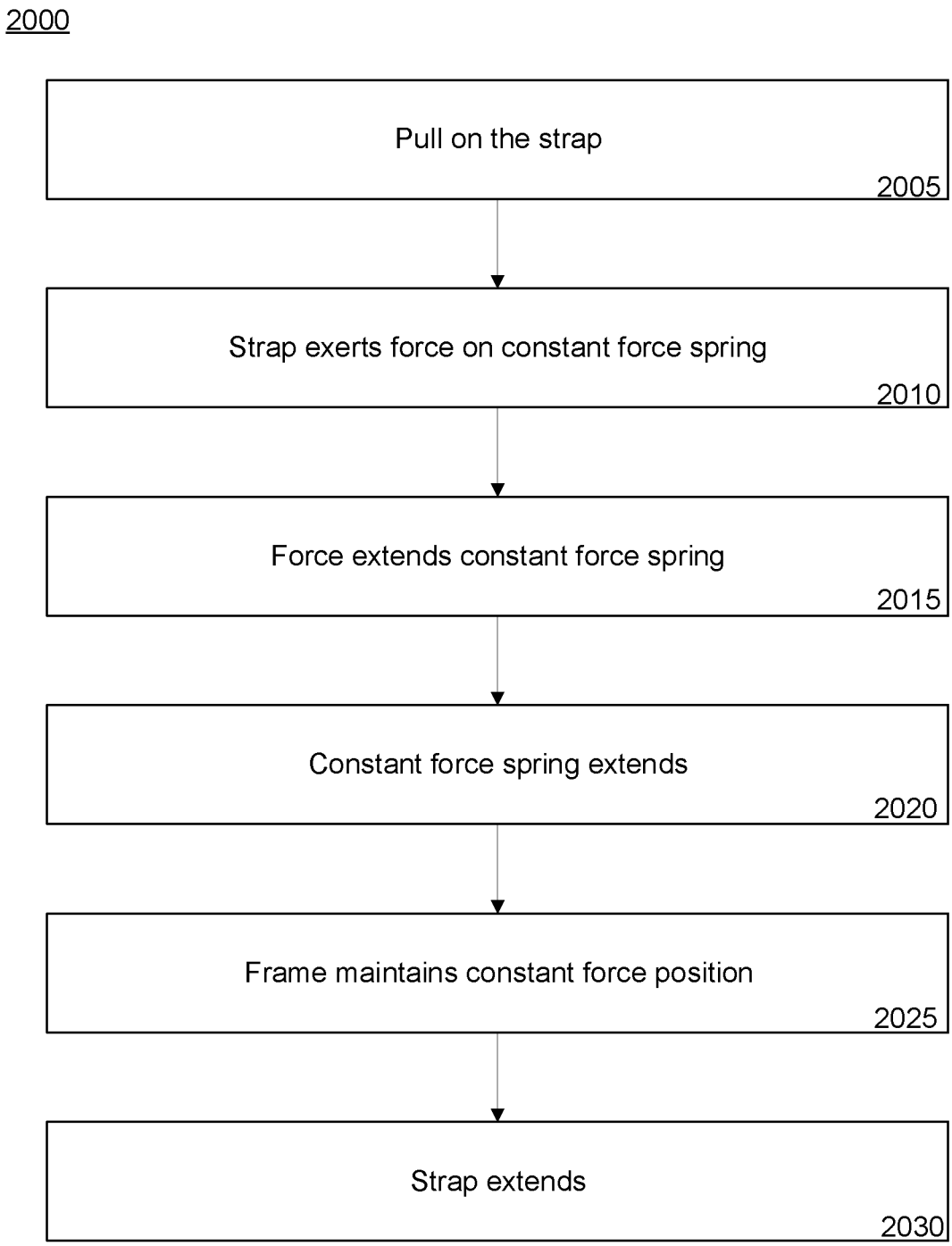
FIG. 20 illustrates an exemplary method for using a bag with an extendable strap, according to some embodiments of the present disclosure.

Referring now to FIG. 20, exemplary method steps 2000 for using a bag with an extendable strap is illustrated. At 2005, the retractable strap may be pulled to activate the system. In some embodiments, at 2010, pulling the retractable strap may exert force on the torsional spring 2010. At 2015, the exerted force may extend the torsional spring. In some aspects, the torsional spring may exert force on the retractable strap via rotational motion inherent in a torsional spring. In some embodiments, the constant force exerted on the retractable strap may be exerted as a result of the rotational force of the torsional spring as it resists extension and tries to resume its initial coiled state.

In some implementations, at 2020, the torsional spring may exert a constant force 2020 on the retractable strap after being extended. In some embodiments, the torsional spring may avoid plastic deformation from the force exerted by pulling the retractable strap because, contrary to a linear spring with a line of force parallel to the orientation of the coils of the spring, the pulling force acts on a torsional spring with a force perpendicular to the orientation of the coils.

In some aspects, at 2025, the frame may maintain the torsional spring's position as the torsional spring exerts constant force. In some embodiments, at 2030, the retractable strap may extend. In some embodiments, the process may be reversed when the retractable strap is being retracted into the bag.

CONCLUSION

A number of embodiments of the present disclosure have been described. While this specification contains many specific implementation details, these should not be construed as limitations on the scope of any disclosures or of what may be claimed, but rather as descriptions of features specific to particular embodiments of the present disclosure.

Certain features that are described in this specification in the context of separate embodiments can also be implemented in combination or in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Moreover, the separation of various system components in the embodiments described above should not be understood as requiring such separation in all embodiments, and it should be understood that the described components and systems can generally be integrated together in a single product or packaged into multiple products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed disclosure.

What is claimed is:

1. A bag with retractable strap, the bag comprising:

a frame comprising:

a center frame comprising four connected rigid walls, an inner frame comprising four connected rigid walls configured to attach to at least a portion of the center frame; and an outer frame comprising at least two rigid walls configured to attach to at least a portion of the center frame, wherein the center frame is configured between the inner frame and the outer frame;

a retractable strap comprising a first end and a second end;

an outer material configured to cover a portion of the retractable strap and a portion of the outer frame, wherein the outer material and the outer frame comprise a first strap opening and a second strap opening;

an inner material covering the center frame, wherein the inner material is configured to form an interior containing recess of the bag;

an outer panel configured to be partially detachable to allow access to the interior containing recess;

a set of constant force springs configured to control a set of positions of the retractable strap, wherein a first constant force spring is connected to the first end and a second constant force spring is connected to the second end; and a set of frame mounts configured to mount the set of constant force springs to the center frame, wherein a first frame mount mounts the first constant force spring to the center frame and a second frame mount mounts the second constant force spring to the center frame, wherein, when mounted, the retractable strap extends through the first strap opening and the second strap opening allowing for access to the retractable strap, and wherein, when mounted, each constant force spring is enclosed by the outer frame.

2. The bag of claim 1, wherein the bag comprises a backpack.

3. The bag of claim 1, wherein the bag comprises a laptop bag.

4. The bag of claim 1, wherein one or both the outer panel and the inner material comprises a modular pocket system.

5. The bag of claim 1, wherein the retractable strap comprises a flexible material.

6. A retractable strap mechanism for bag, the retractable strap mechanism comprising:

a frame comprising:

a center frame comprising four connected rigid walls, an inner frame comprising four connected rigid walls configured to attach to at least a portion of the center frame, and an outer frame comprising at least two rigid walls configured to attach to at least a portion of the center frame, wherein the outer frame comprises a first strap opening and an second strap opening, wherein the center frame is configured between the inner frame and the outer frame;

a retractable strap comprising a first end and a second end;

a set of constant force springs configured to control a set of positions of the retractable strap, wherein a first constant force spring is connected to the first end and a second constant force spring is connected to the second end; and a set of frame mounts configured to mount the set of constant force springs to the center frame, wherein a first frame mount mounts the first constant force spring to the center frame and a second frame mount mounts the second constant force spring to the center frame, and wherein, when mounted, the retractable strap extends through the first strap opening and the second strap opening allowing for access to the retractable strap, and wherein, when mounted, each constant force spring is enclosed by the outer frame.

7. The retractable strap mechanism of claim 6, wherein the retractable strap comprises a flexible material.

8. The retractable strap mechanism of claim 6, wherein the bag comprises a backpack.

9. The retractable strap mechanism of claim 6, wherein the set of constant force springs extends via rotational extension.

10. The retractable strap mechanism of claim 9, wherein the set of constant force springs transfers rotational retention force to a linear force exerted on the retractable strap mechanism.

11. The retractable strap mechanism of claim 10, wherein the force exerted by the set of constant force springs on the retractable strap mechanism is maintainable in a modified level of constant force by an external force exerted on the set of constant force springs.

* * * * *